US010186778B2

(12) United States Patent
Zemliakov

(10) Patent No.: US 10,186,778 B2
(45) Date of Patent: Jan. 22, 2019

(54) WIDEBAND DUAL-POLARIZED PATCH ANTENNA ARRAY AND METHODS USEFUL IN CONJUNCTION THEREWITH

(71) Applicant: MTI WIRELESS EDGE, LTD., Rosh Ha'ayin (IL)

(72) Inventor: Sergey Zemliakov, Rehovot (IL)

(73) Assignee: MTI WIRELESS EDGE, LTD., Rosh Ha'ayin (IL)

( * ) Notice: Subject to any disclaimer, the term of this patent is extended or adjusted under 35 U.S.C. 154(b) by 32 days.

(21) Appl. No.: 14/624,831

(22) Filed: Feb. 18, 2015

(65) Prior Publication Data

US 2015/0236421 A1 Aug. 20, 2015

(30) Foreign Application Priority Data

Feb. 18, 2014 (IL) ..... 231026

(51) Int. Cl.
*H01Q 9/04* (2006.01)
*H01Q 21/06* (2006.01)
*H01Q 21/00* (2006.01)

(52) U.S. Cl.
CPC ..... *H01Q 9/045* (2013.01); *H01Q 9/0414* (2013.01); *H01Q 21/0075* (2013.01); *H01Q 21/065* (2013.01); *H01Q 9/0435* (2013.01); *Y10T 29/49016* (2015.01)

(58) Field of Classification Search
CPC .. H01Q 21/0075; H01Q 9/045; H01Q 21/065; H01Q 9/0414; H01Q 9/0435
See application file for complete search history.

(56) References Cited

U.S. PATENT DOCUMENTS 4,766,440 A 8/1988 Gegan
6,121,929 A * 9/2000 Olson ..... H01Q 1/38 343/700 MS
2007/0159398 A1 7/2007 Tsai et al.
(Continued)

FOREIGN PATENT DOCUMENTS

EP 1681742 A1 7/2006

OTHER PUBLICATIONS

Antenna (radio), https://en.wikipedia.org/w/index.php?title=Antenna_(radio)&oldid=595717675—Feb. 16, 2014.
(Continued)

*Primary Examiner* — Jessica Han
*Assistant Examiner* — Michael Bouizza
(74) *Attorney, Agent, or Firm* — Browdy and Neimark, P.L.L.C.

(57) ABSTRACT

A flat antenna element including at least one radiating patch; and at least one impedance transformer including a feed-point arm connected to the patch which intersects between micro-strip feed lines and the radiating patch, wherein said arm has a first end electrically connected to an individual feed line and a second end which is electrically connected to the patch, and wherein said second end electrically connected to the patch has a width small enough to yield a level of impedance, for the arm, which is more than, e.g. more than twice, the level of impedance of the patch, and wherein the width of the feed line of end connected to patch is narrower than the end connected to the feed line.

13 Claims, 30 Drawing Sheets

(56) References Cited

U.S. PATENT DOCUMENTS

| | | | | |
|---|---|---|---|---|
| 2009/0140927 | A1* | 6/2009 | Maeda | H01Q 9/0407 343/700 MS |
| 2012/0003946 | A1 | 1/2012 | Ono | |
| 2013/0314284 | A1 | 11/2013 | Tasaki et al. | |

OTHER PUBLICATIONS

Wideband, https://en.wikipedia.org/w/index.php?title=Wideband&oldid=569809497—Aug. 23, 2013.

Huang, J. (1991). Dual polarized microstrip array with high isolation and low cross polarization. Microwave and Optical Technology Letters, 4(3), 99-103.

Tsao, C. H., Hwang, Y. M., Kilburg, F., & Dietrich, F. (Jun. 1988). Aperture-coupled patch antennas with wide-bandwidth and dual-polarization capabilities. In Antennas and Propagation Society International Symposium, 1988. AP-S. Digest (pp. 936-939).

Wollenschläger, F., Stephan, R., Xia, L., Müller, J., Müller, R., Ariza, A. P. G., . . . & Hein, M. (Apr. 2011). A compact dual-polarized wideband patch antenna array for the unlicensed 60 GHz band. In Antennas and Propagation (EUCAP), Proceedings of the 5th European Conference on (pp. 1873-1877).

"Wideband Dual Linear Polarised Patch Array Antennas" by Gi Cho Kang published by the University of Kwangwoon, Korea (2002).

Dastkhosh, A. R., & Dalili Oskouei, H. R. (2011). A wideband high-gain dual-polarized slot array patch antenna for WiMAX applications in 5.8 GHz.lntemational Journal of Antennas and Propagation, 2012.

"Dual Polarization Stacked Microstrip Patch Antenna Array With Very Low Cross-Polarization" by Johan Granholm, published in IEEE Transactions and Propagation, Oct. 2001.

Jianjun Liu et al: "An extremely wideband rectangular monopole antenna with a modified microstrip feed", Antennas and Propagation (EUCAP), 2010 Proceedings of the Fourth European Conference on, IEEE, Piscataway, NJ, USA, Apr. 12, 2010, pp. 1-5.

Margaret D H et al: Cross Slot Antenna With Open Ended Truncated Patch Feed for Ultra Wide Band Applications11, 2009 International Conference on Control, Automation, Communication and Energy Conservation (INCACEC), Jun. 4-6, 2009, Perundurai, Tamilnadu, India, IEEE, Piscataway, NJ, USA, Jun. 2009, pp. 1-6.

* cited by examiner

WIDEBAND DUAL-POLARIZED PATCH ANTENNA ARRAY AND METHODS USEFUL IN CONJUNCTION THEREWITH

REFERENCE TO CO-PENDING APPLICATIONS

Priority is claimed from Israeli Patent Application No. 231026, filed 18 Feb. 2014 and entitled "Wideband dual-polarized patch antenna array and methods useful in conjunction therewith".

FIELD OF THIS DISCLOSURE

The present invention relates generally to antennae and more particularly to patch antennae.

BACKGROUND FOR THIS DISCLOSURE

Antennas may also include reflective or directive elements or surfaces not connected to the transmitter or receiver, such as parasitic elements, which serve to direct the radio waves into a beam or other desired radiation pattern.

A conventional wide band patch array has a parasitic patch disposed above the active fed element. The parasitic patch may for example be about 20% larger than the active fed element.

SUMMARY OF CERTAIN EMBODIMENTS

Certain embodiments of the present invention seek to provide an improved patch antenna e.g. as opposed to stack antennae which require more than one layer of printed circuit (one layer for feeds and another layer for radiating elements) and may provide a relative bandwidth of no more than about 20% unless performance quality is sacrificed. The improved antenna may for example be used to form a dual polarized planar array with a Gain of over 20 dbi, isolation between ports of more than 25 db, and VSWR of better than 1.7:1 over a bandwidth of more than 30%.

Certain embodiments of the present invention seek to provide a wideband dual polarized patch antenna array.

Certain embodiments of the present invention seek to provide a flat patch which can be used in a multi-element planar array.

Certain embodiments of the present invention seek to provide a flat antenna with good performance whose relative bandwidth is over 20%, or over 25%, or over 30%, or over 33%.

Certain embodiments of the present invention seek to provide a wideband flat patch which typically can be used in a multi-element dual polarized planar array.

Certain embodiments of the present invention seek to provide an antenna being symmetrical and/or having a feed at the edge of the element, thereby to be suited for inclusion in dual polarized arrays.

Certain embodiments of the present invention seek to provide a wideband impedance transformer.

Certain embodiments of the present invention seek to provide a high impedance transformer which converts a low impedance patch to a high impedance at the input to the transformer, as opposed to conventional devices which, to convert a low impedance to a high impedance, a transformer is used, whose impedance is low on the patch side and high on the input side.

Certain embodiments of the present invention seek to provide an arm electrically connected to the patch which may narrow as it approaches the patch, such that the arm-end further from the patch is wider than the arm-end connecting to the patch. Additional capacitive arm/s may also be provided. These may also narrow as they approach the patch.

Certain embodiments of the present invention seek to modify the parasite element above the active element so as to increase the bandwidth of the design. The antenna may be provided with a parasitic patch, which may or may not be larger, say 30% or 50% or 70% larger, than the active patch; the parasitic patch may also be smaller, say 10-20% smaller, than the active patch. For example, the total size of the parasitic patch may be approximately 27 mm×27 mm. The parasitic patch may be formed of n>1 (e.g. four) smaller closely (relative to the patch dimension) spaced and optionally interconnected parasitic elements, also termed herein "tiles". Provision of parasitic "tiles" may increase the bandwidth of the antenna from around 33% to 40% and/or the VSWR and/or the Gain may increase at the lower and/or higher end of the band.

A particular advantage of certain embodiments is resulting improvement in VSWR and/or Gain and/or Patterns.

There is also provided, according to certain embodiments, an antenna, e.g. a printed patch antenna, which includes at least one active element; and a plurality of parasitic elements above the active element, thereby to increase antenna gain relative to a same-size parasitic patch formed of only one element.

Typically, the plurality of parasitic elements are spaced from one another along at least a portion of their respective perimeters.

Typically, the plurality of parasitic elements are spaced from one another along at least a majority of their respective perimeters.

Typically, the plurality of parasitic elements comprise disjoint elements spaced from one another.

Typically, the plurality of parasitic elements is co-planar.

Typically, the parasitic elements each comprise a regular polygon.

The terms used herein may be construed either in accordance with any definition thereof appearing in the prior art literature or in accordance with the specification. For example:

Series elements: patches connected in series. In series feed, antenna elements such as patches are connected directly (in series e.g.) which is simpler. Nonetheless, for optimum wideband performance, the best feed is, conventionally, parallel feed. However parallel feed results in many feed lines which can cause interaction between lines, resulting in distortion in the radiation patterns.

Series arms: arms, e.g. microstrip lines, which connect series elements.

Extended series elements: the elements at the extremities of (say) the four element configuration of FIG. 3.

parasite: typically comprises a passive patch placed at a suitable height e.g. around 2-3 mm or 1-5 mm above the radiating patch, to increase effective patch bandwidth.

Relative bandwidth: $(f1-f2)/(f1+f2)$, i.e. the ratio between the difference between the highest (f1) and lowest (f2) frequencies of interest, and the sum thereof. The bandwidth defined typically means that the antenna operates with a VSWR of say 1.5:1 over the band. Other parameters such as Gain, beamwidth and side lobes typically do not deteriorate over this band.

Semi-Reactive Connection—A set of arms, some e.g. two of which are reactively coupled to a patch while at least another, typically centrally located, arm is directly connected to the patch.

Wideband impedance transformer: feed mechanism to a flat antenna element e.g. stack patch, typically comprising a thin arm electrically connected to a patch via an approximate midpoint of one of the four (say) sides of the patch. The term "thin" may for example refer to a width, at the narrow end of the arm, which yields an impedance of, say, 100 or 150 or 200 ohm or more at the frequency desired. The approximate midpoint may be equidistant (located at 50% of the distance) from the adjacent patch vertices, as shown, or may be located at 35% or 40% or 45% or any percentage there between of the distance from one of the adjacent patch vertices, and 65% or 60% or 55% or any percentage there between of the distance from the other one of the adjacent patch vertices. The width of the arm is typically non-uniform such that the end contacting the patch is either wider or narrower than the end distant from the patch.

Example: TFSR e.g. as shown in FIG. 9; or any of the feed mechanisms shown in FIGS. 19*a*-19*j* including those with only one arm and without capacitive arms.

The present invention typically includes at least the following embodiments:

Embodiment 1. A flat antenna element including:

at least one radiating patch; and at least one impedance transformer including a feed-point arm connected to the patch which intersects between micro-strip feed lines and the radiating patch, wherein the arm has a first end electrically connected to an individual feed line and a second end which is electrically connected to the patch, and wherein the second end electrically connected to the patch has a width small enough to yield a level of impedance, for the arm, which is more than, e.g. more than twice, the level of impedance of the patch, and wherein the width of the feed line of the end connected to the patch is narrower than the end connected to the feed line.

Embodiment 2. An antenna element according to Embodiment 1 wherein the transformer also comprises at least one additional arm capacitively coupled to the patch.

Embodiment 3. An antenna element according to any of the previous embodiments e.g. Embodiment 2 wherein the at least one additional arm comprises a pair of arms capacitively coupled to the patch and disposed on either side of the connected arm.

Embodiment 4. A multi-element wideband planar antenna array including an array of inter-connected antenna elements according to any of the previous embodiments e.g. Embodiments 1-3 thereby to increase antenna Gain.

Embodiment 5. An antenna element according to any of the previous embodiments e.g. Embodiments 1-3 wherein the flat patch's height above the ground plane is selected to be small enough to prevent connecting lines between patches from radiating thereby to prevent radiation pattern distortion.

Embodiment 6. An antenna element according to any of the previous embodiments e.g. Embodiments 1-3 and also comprising a parasite above the patch operative to modify the radiation pattern of radio waves emitted by the patch.

Embodiment 7. An antenna element according to any of the previous embodiments e.g. Embodiments 1-3 wherein the patch is slotted, thereby to increase inductance of a patch at a high frequency end.

Embodiment 8. An antenna element according to any of the previous embodiments e.g. Embodiments 1-3 wherein first and second inputs are provided for respective first and second polarizations such that a single element may be used for both of the polarizations.

Embodiment 9. An antenna element according to any of the previous embodiments e.g. Embodiment 1-3 or claim 8 wherein two transformers are employed to feed a single patch, thereby to yield a dual-polarized antenna element.

Embodiment 10. A multi-element wideband dual polarized planar antenna array according to any of the previous embodiments e.g. Embodiment 2 wherein at least a pair of antenna elements are connected by micro-strip feed lines.

Embodiment 11. A method for production of a flat antenna element, the method comprising:

providing at least one radiating patch; and connecting a feed-point arm to the patch, including at least one impedance transformer which intersects between micro-strip feed lines and the radiating patch, wherein the arm has a first end electrically connected to an individual feed line and a second end which is electrically connected to the patch, and wherein the second end electrically connected to the patch has a width small enough to yield a level of impedance, for the arm, which is more than, e.g. more than twice, the level of impedance of the patch, and wherein the width of the feed line of the end connected to the patch is narrower than the end connected to the feed line.

Embodiment 12. An antenna element according to any of the previous embodiments e.g. Embodiments 1-3 wherein the level of impedance, for the arm, is more than twice the level of impedance of the patch.

Embodiment 13. An antenna element according to any of the previous embodiments e.g. Embodiments 1-3 and also comprising two outer series elements on a wideband array, thereby changing the current distribution to result in a radiation pattern with reduced side lobes.

With reference, say, to Embodiment 13: One advantage of this embodiment is that in a series feed, an impedance transformer e.g. TSFR compensates for the changes of phase of the connecting lines over the frequency band.

Variations are possible such as but not limited to a flat antenna element including at least one radiating patch; and at least one impedance transformer including a feed-point arm or feed line connected to the patch which intersects between micro-strip feed lines and the radiating patch, wherein the arm or feed line has a first end electrically connected to an individual feed line and a second end which is electrically connected to the patch, one of whose ends (which may be the end connected to the patch) has a width small enough to yield a level of impedance, for the arm, which is more than, e.g. more than twice, the level of impedance of the patch. According to some embodiments, the width of the end of the feed line connected to the patch is narrower than the end connected to the feed line. According to some embodiments, the second end is wide enough to yield a low level of impedance. According to some embodiments, the feed-point arm widens and the first end has the small width.

Embodiment 14. An antenna element according to any of the previous embodiments e.g. Embodiments 1-3 wherein the at least one impedance transformer comprises two impedance transformers such that the antenna is dual-polarized.

Embodiment 15. An antenna element according to any of the previous embodiments e.g. Embodiment 3 wherein at least one of the pair of arms has a "dovetailed" portion which widens as the arm approaches the patch.

Embodiment 16. An antenna element according to any of the previous embodiments e.g. Embodiment 4 wherein the array of antenna elements is interconnected by feed lines including the individual feed line.

Embodiment 17. An antenna element according to any of the previous embodiments e.g. Embodiments 1-3 wherein the feed-point arm narrows and the second end has the small width.

Embodiment 18. An antenna element according to any of the previous embodiments e.g. Embodiments 1-3 and also comprising a ground plate below the flat radiating patch.

Embodiment 19. An antenna element according to any of the previous embodiments e.g. Embodiments 1-3 wherein the connected arm is electrically connected to the patch at an approximate midpoint of a side of the patch.

Embodiment 20. An antenna element according to any of the previous embodiments e.g. Embodiment 5 wherein the height is less than 0.05 wavelengths generated by the radiating patch.

Embodiment 21. An antenna element according to any of the previous embodiments e.g. Embodiments 1-3 wherein the level of impedance of the radiating patch is at least 200 ohm.

Embodiment 22. An antenna element according to any of the previous embodiments e.g. Embodiment 20 wherein the height is 0.01-0.02 wavelengths of radiation generated by the radiating patch.

With reference, say, to Embodiments 5, 20, 22, the height may for example be 0.8 mm. It is appreciated that microstrip lines interconnecting patches cannot be designed to specific impedances if the microstrip lines are too high above the ground plate.

Example: Given a frequency of from 4.3 to 6.5 Ghz; the patch radiation's wavelength at the center of the band may be around 56 mm. The height of the patch is then very small e.g. around 0.014 wavelengths, which would generally result in a very narrow bandwidth for the patch e.g. about 2% to 3%. Adding a Parasite element and radome can increase the bandwidth to about 10% to 15%. However, use of a TSFR as described herein may increase the bandwidth to between 30 and 35%. Matching may be effected with the microstrip lines with various widths and lengths and/or by employing a hybrid junction.

The embodiments referred to above, and other embodiments, are described in detail in the next section.

Any trademark occurring in the text or drawings is the property of its owner and occurs herein merely to explain or illustrate one example of how an embodiment of the invention may be implemented.

Elements separately listed herein need not be distinct components and alternatively may be the same structure.

BRIEF DESCRIPTION OF THE DRAWINGS

Certain embodiments of the present invention are illustrated in the following drawings:

FIG. 1*a* is a top view of a dual polarized patch with TFSR (triple feed semi reactive) feed and FIG. 1*b* is an isometric view of dual polarized patch with TFSR feed and a radome. The TFSR feed typically extends from the patch toward three lines which interconnect a patch either directly or being capacitively coupled e.g. as shown and described herein.

with reference to FIG. 3.

DETAILED DESCRIPTION OF CERTAIN EMBODIMENTS

A Wideband Dual Polarized Patch antenna Array provided in accordance with certain embodiments is now described with reference to FIGS. 1*a*-4. The antenna is an extremely wideband patch antenna array, typically having over 30% relative bandwidth. It is appreciated that wideband patch antennas exist which are not suitable for dual polarized arrays. Wideband elements are usually raised above the ground plane but conventional raised elements may not be used in planar arrays since the connecting lines may radiate and result in distorted radiation patterns. Conventional wideband elements such as the U or E patch are not suitable for dual polarized arrays since they are not symmetrical and the feed is usually not at the edge of the element. The antenna of FIGS. 1-4 comprises a wideband flat patch which can be used in a multi-element planar array; the antenna is suitable for dual polarized arrays being symmetrical and having a feed at the edge of the element.

Figure 9:
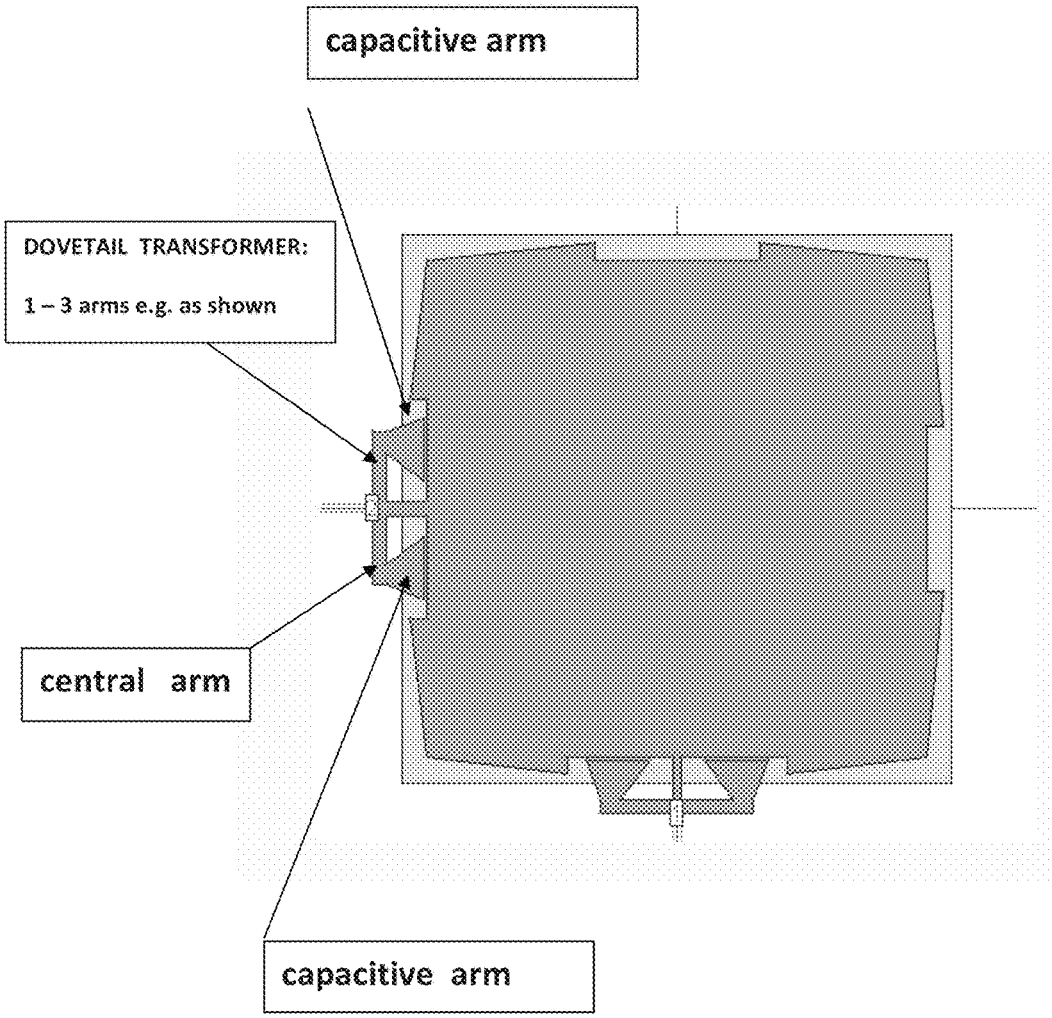
FIG. 9 is a diagram of a shaped patch antenna with TSFR feed, and optional parasite, according to an embodiment of the invention.

Conventional patch arrays have bandwidths of a few percent. Patches with parasitic elements can reach bandwidths of between 10% and 15%. The element of FIGS. 1*a*-4, as well as other embodiments described herein, such as but not limited to the embodiment of FIG. 9, are useful for producing a wideband dual polarized planar array which is highly efficient relative to prior art, and have similarly sized (have similar dimensions to) antennae with a conventional Microstrip patch and parasitic element. The triple feed semi reactive (TFSR) feed may, as described below, be replaced with a structure having only one or two arms rather than three; or with a structure whose arms are not "dovetailed", where "dovetailed" refers to at least one arm which narrows (tapers) as it approaches the patch. The patch's height may, for example, be only 0.8 mm above the ground plane. More generally, the flat patch is typically 0.01-0.02 wavelengths ( ) above the ground plane, thereby to prevent radiation of connecting lines.

For example, given a frequency within the range of 4.4-6.2 GHz, since dimensions selected for various aspects of an antenna are typically frequency-dependent, the width of the end of the arm which is adjacent the patch, may be less than 1 mm, or less than 0.6 mm wide, or less than 0.5 mm wide, or less than 0.4 mm wide, or less than 0.3 mm wide, thereby to provide a high level of impedance at the second end, such as perhaps 70, 100 or 200 ohm, relative to the level of impedance of the patch which may for example be as low as 40 ohm. It is appreciated that the patch and arms may be formed of microstrips on a printed circuit.

The TFSR typically includes a central arm electrically connected to the patch. Two additional arms may be provided which are capacitively coupled to the patch on either side, typically, of the central arm. The TFSR is typically useful for improving the VSWR, and/or the field distribution on the patch, such that radiation patterns are typically optimum over the whole band. A patch at high frequencies can generate higher order modes which may cause high sidelobes. By feeding the patch at three points, the patch is effectively divided into smaller parts, hence canceling out the higher order modes and maintaining the dominant mode as required for optimum performance.

The radiating patch is typically on the ground. The parasite may for example be about 3 mm above the radiating patch, plus or minus a few tens of a millimeter or plus/minus a millimeter. The radome is above both.

Typically, conducting lines are copper. The dielectric may for example be polypropylene. However, other materials are possible, albeit are typically less cost-effective, such as Teflon.

Figure 1A:
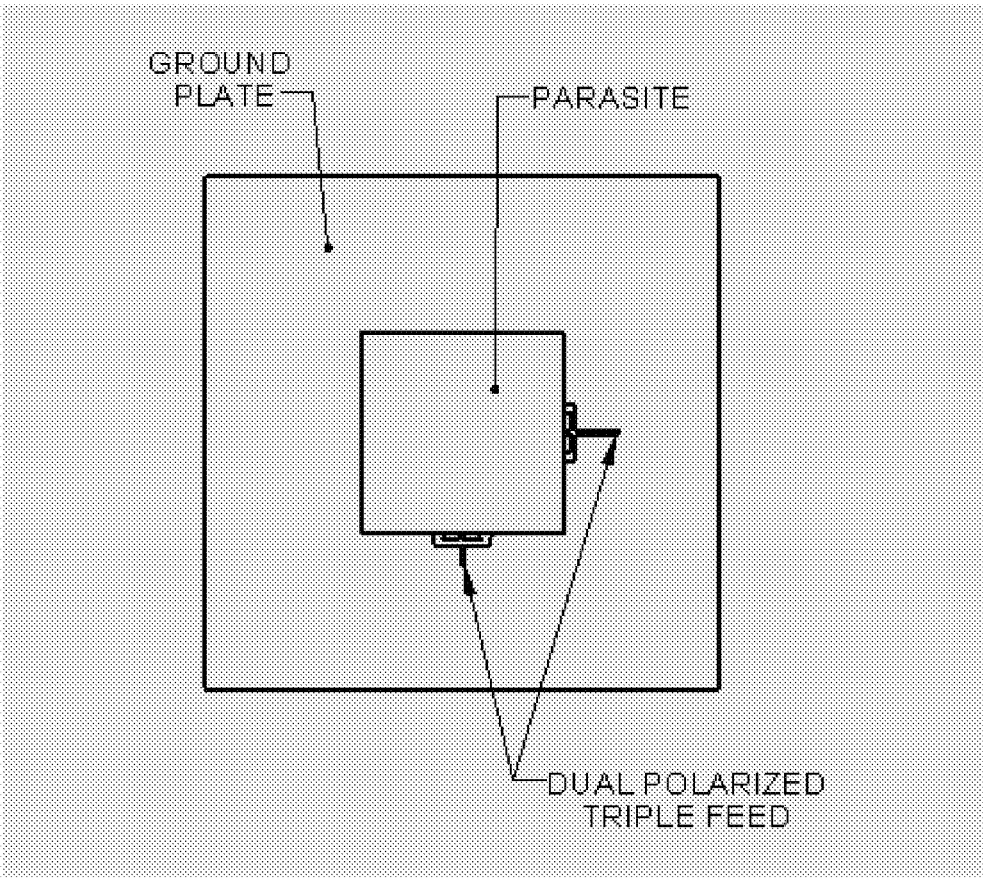
FIGS. 1*a*-1*b* illustrate an example Layout of an Antenna Patch with TFSR feed, according to certain embodiments of the present invention; in particular.
Figure 1B:
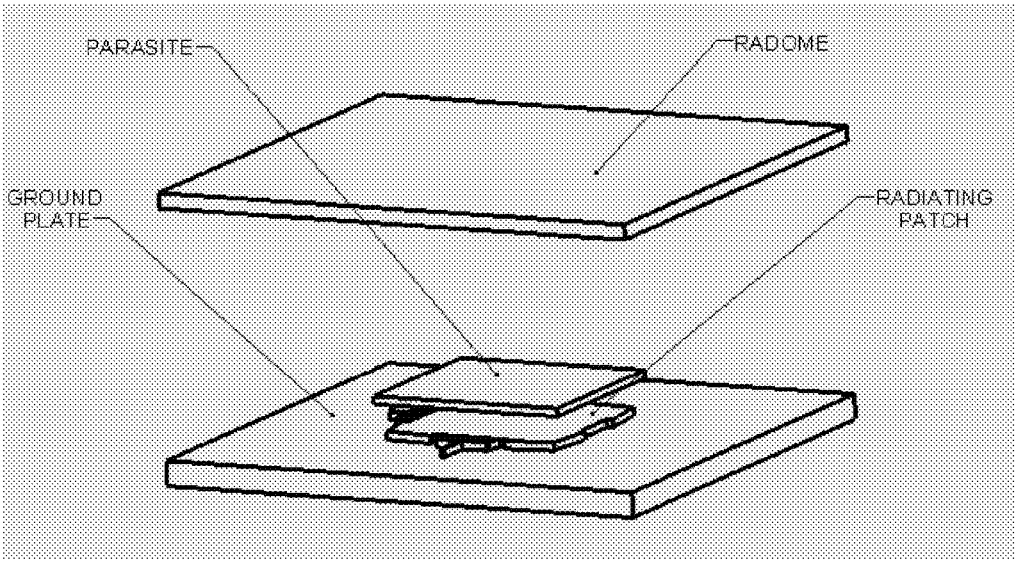
Figure 2:
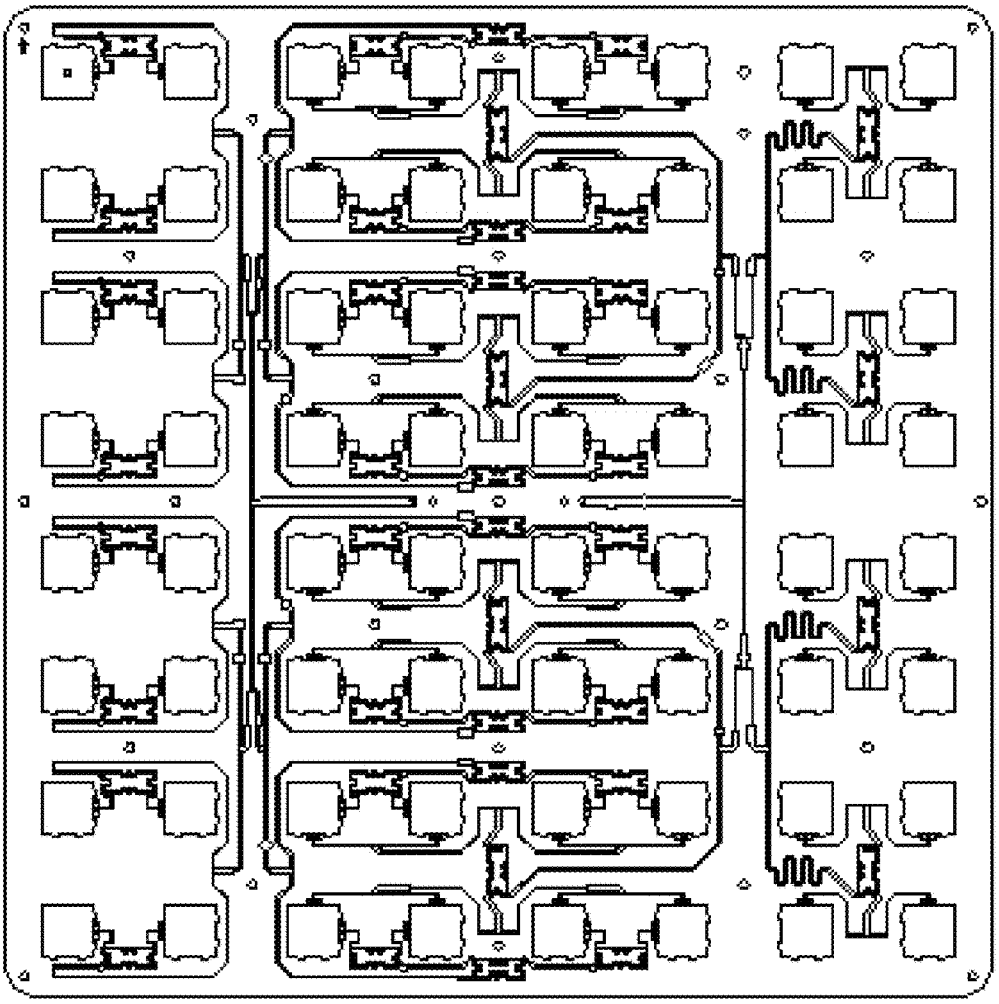
FIG. 2 illustrates an example Dual Polarized Planar Array using TFSR Feed according to certain embodiments of the present invention.
Figure 11:
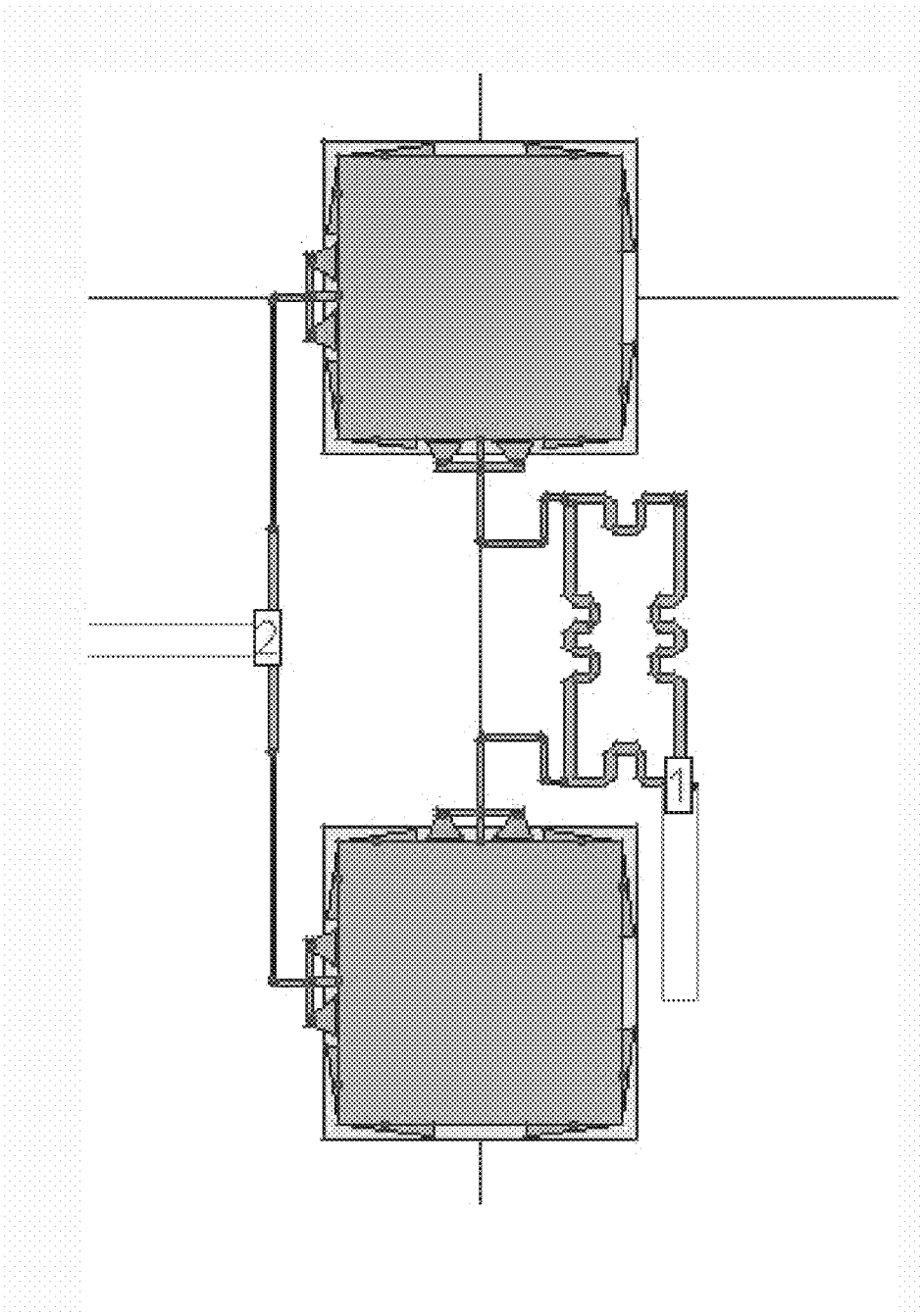
FIG. 11 is a diagram of a dual polarized array of two element antennae units, using TSFR Feed, according to an embodiment of the invention.
Figure 13:
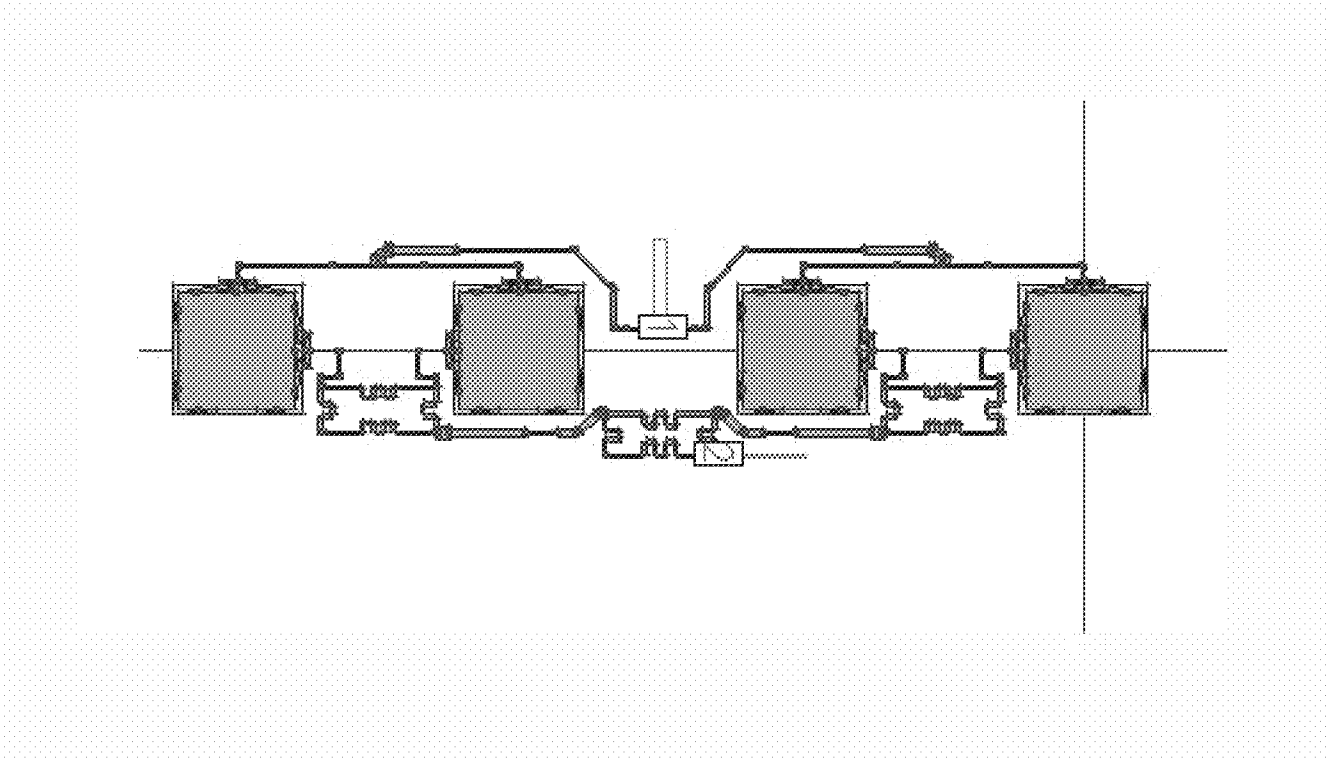
FIG. 13 is a diagram of a dual polarized array of four element antennae units, using TSFR feed, according to an embodiment of the invention.

FIG. 2 shows an array of antenna elements, each element of which may comprise the apparatus of FIG. 1. FIG. 2 uses the TSFR e.g. of FIG. 9, described in detail below, for an array with a wide bandwidth. Possible portions of the array, for two and four elements, are shown in FIGS. 11 and 13 respectively.

Figure 3:
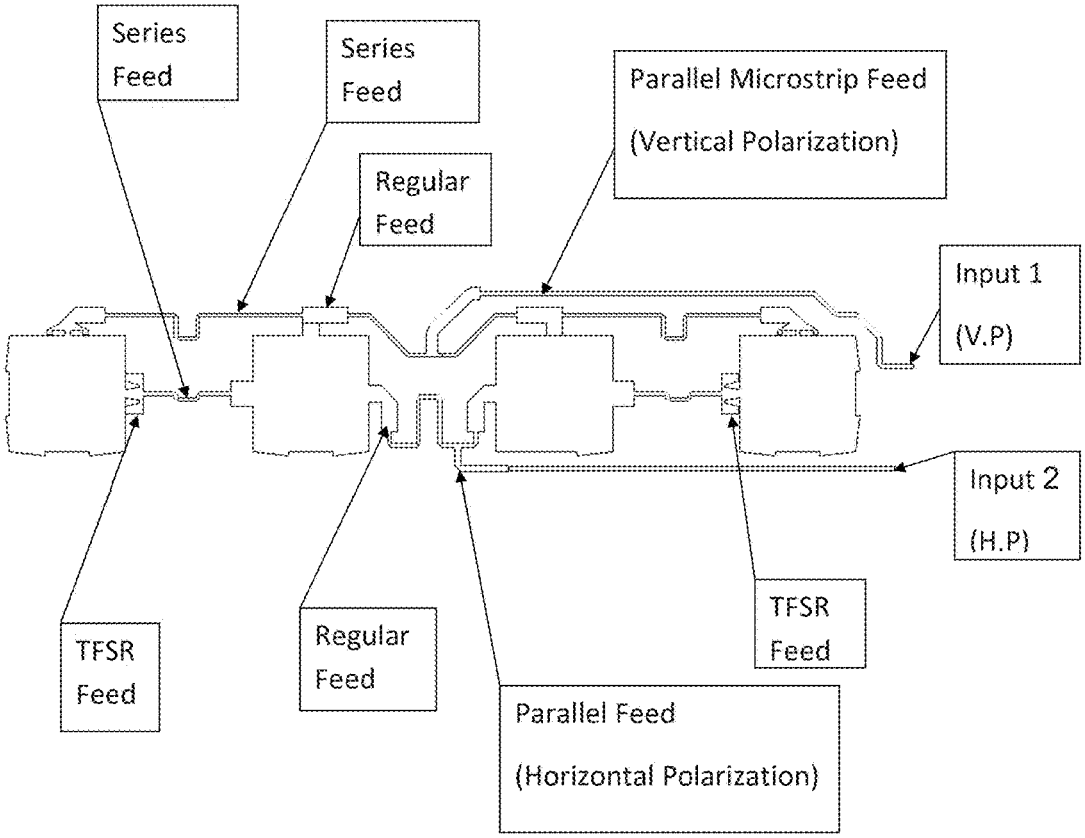
FIG. 3 illustrates a Four-element (say, or more generally n-element) Dual Polarized array using the TFSR feed arrangement on, or only on, outer patches from among the n patches provided, according to certain embodiments of the present invention; it is appreciated that TSFR (or other feeds shown and described herein) used at the extremities, is advantageous.

FIG. 3 shows a configuration for connecting four elements e.g. patches using a center fed series feed and using the TSFR. The apparatus of FIG. 3 typically comprises a "mini-array" of four antenna elements including two outer series elements. Provision of two outer series elements on a wideband array would normally result in a radiation pattern with high side lobes. However, provision of the TFSR feed arrangement as shown is advantageous; the current distribution changes and side lobes are drastically reduced. The elements at the extremities are in series and hence require a smaller number of feed lines relative to parallel feed.

Figure 4:
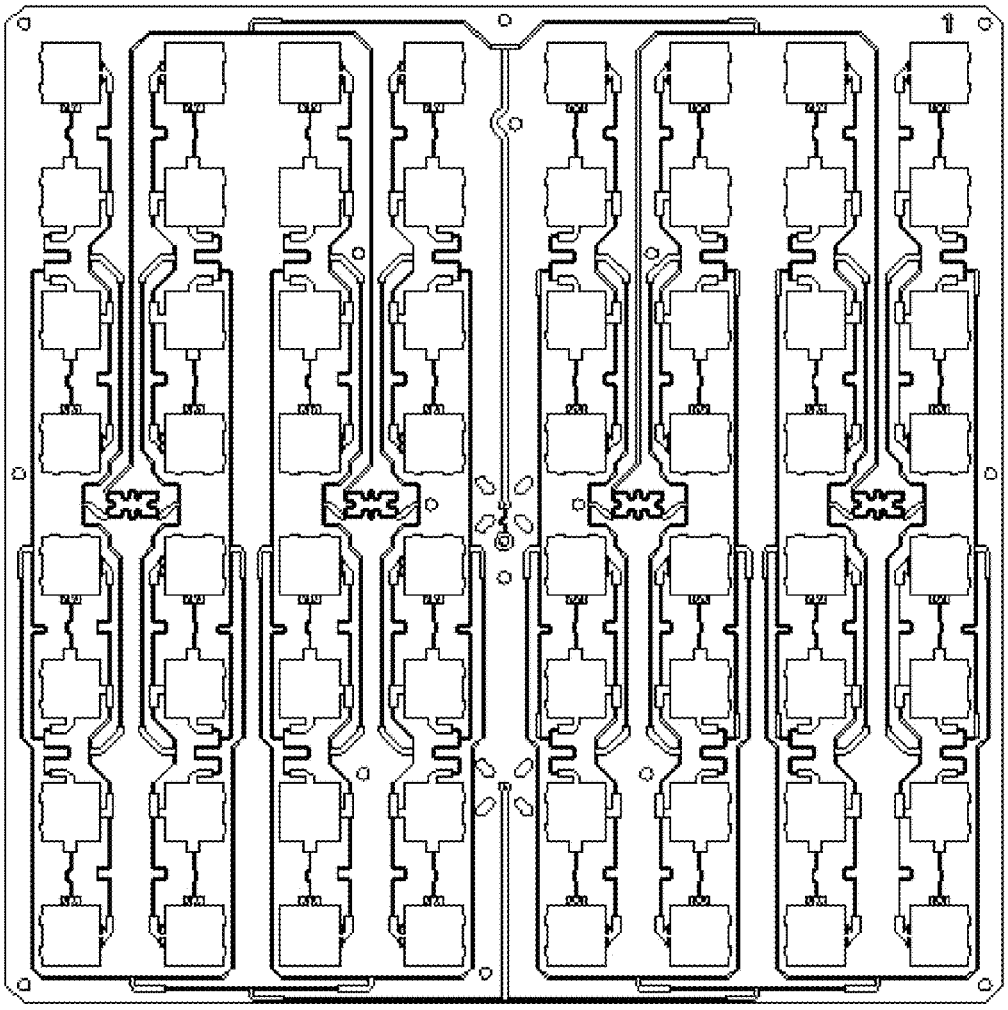
FIG. 4 illustrates an example Dual polarized planar Array using the TFSR feed on extended series elements according to certain embodiments of the present invention.

FIG. 4 illustrates a planar array formed of "micro-arrays" e.g. as shown in FIG. 3. FIG. 4 uses the apparatus of FIG. 3 but employs series arms. Series arms are conventionally narrowband but the addition of TFSR, as shown, renders them wideband, as shown in the radiation patterns illustrated and described herein. A particular advantage of the apparatus of FIG. 4 is that a smaller antenna can be made if the series technique is employed. The feed mechanisms shown and described herein (e.g. the TFSR or any of those shown in FIGS. 19*a*-19*j* or described herein), then, are particularly useful in that elements with a feed mechanism as shown and described may be incorporated into an array, using any suitable method to build the array.

A particular advantage of the embodiment of FIGS. 3-4 is reduction of side lobes and/or cross polarization of antenna with a series feed. It is appreciated that the series feed does not normally operate over a wideband since the phase between elements changes, resulting in high cross polarization and high side lobes. However the TSFR is designed to compensate for the phase change hence reducing the side lobes and cross polarization.

Figure 19A:
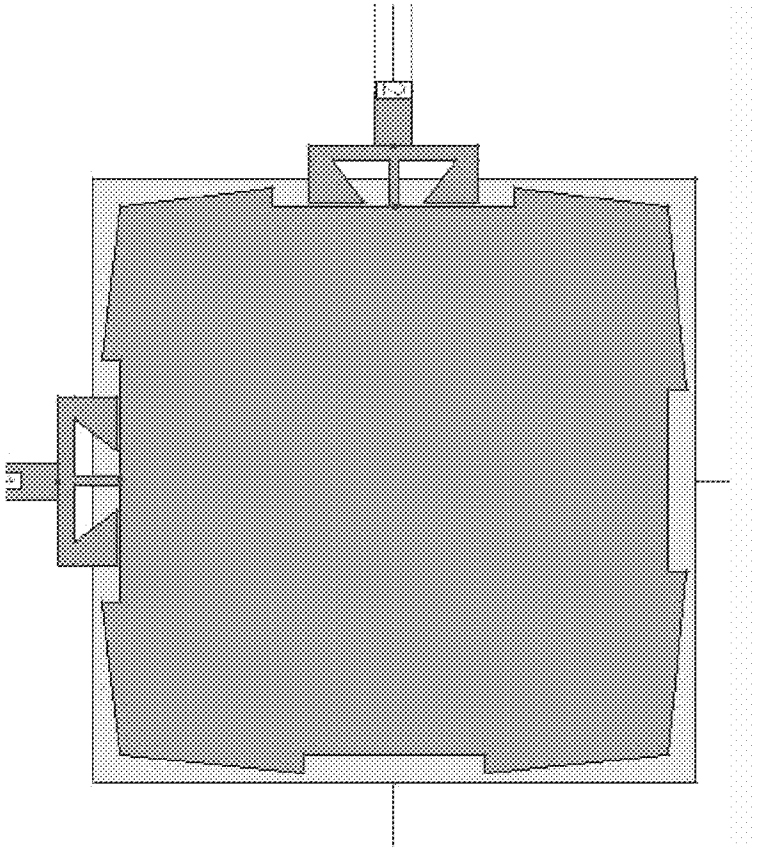
FIGS. 19*a*-19*j* are examples of possible variations on the shape of the connecting and capacitive arms shown in conjunction with their associated patch and optional parasite.
Figure 19B:
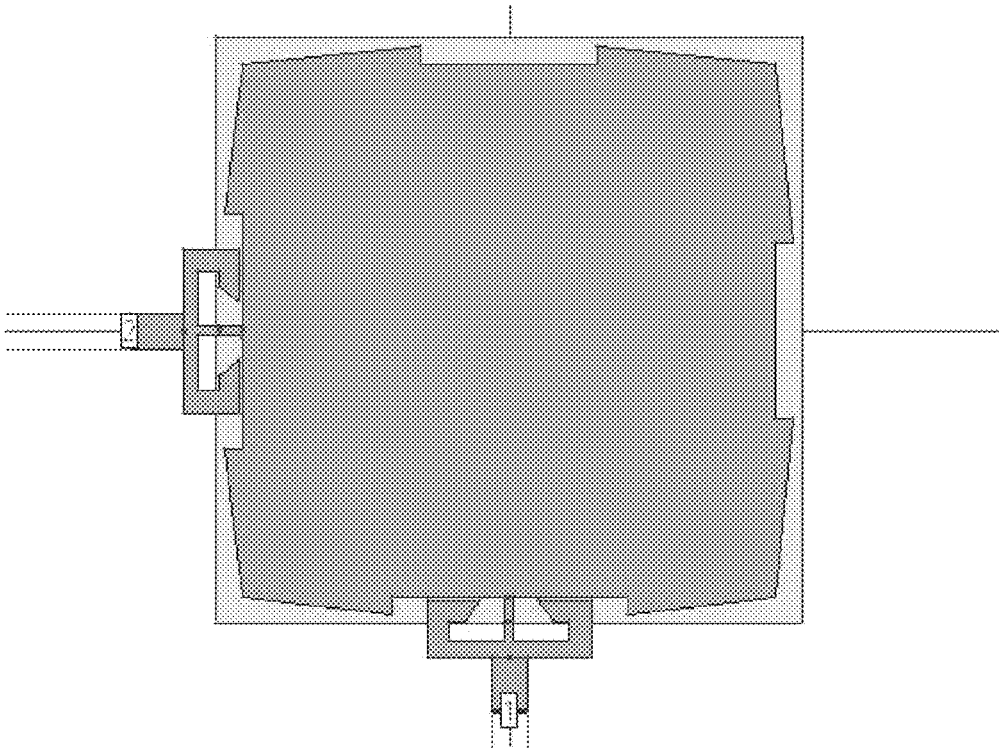
Figure 19C:
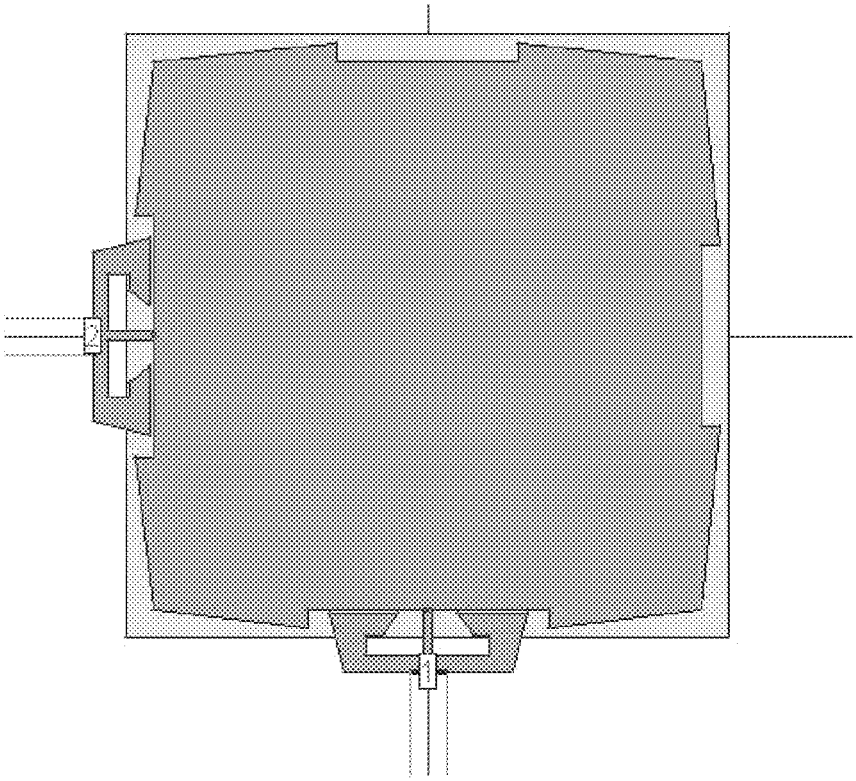
Figure 19D:
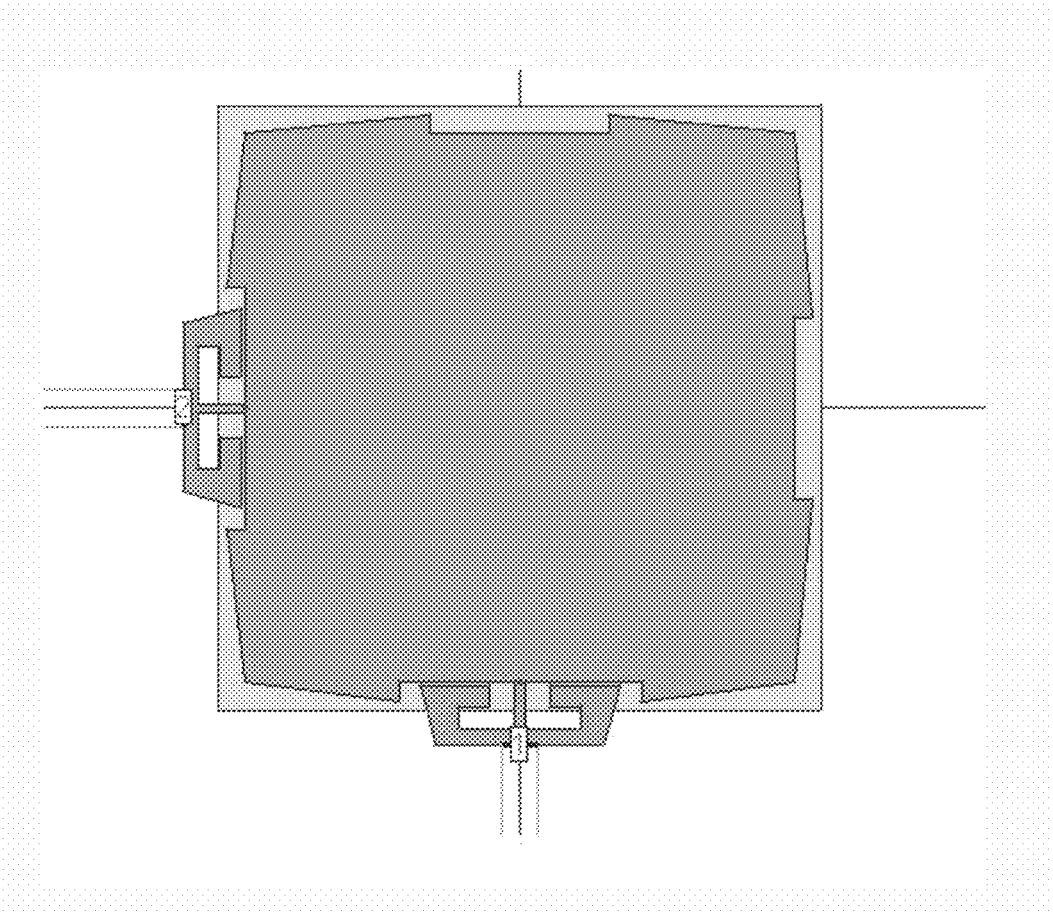
Figure 19E:
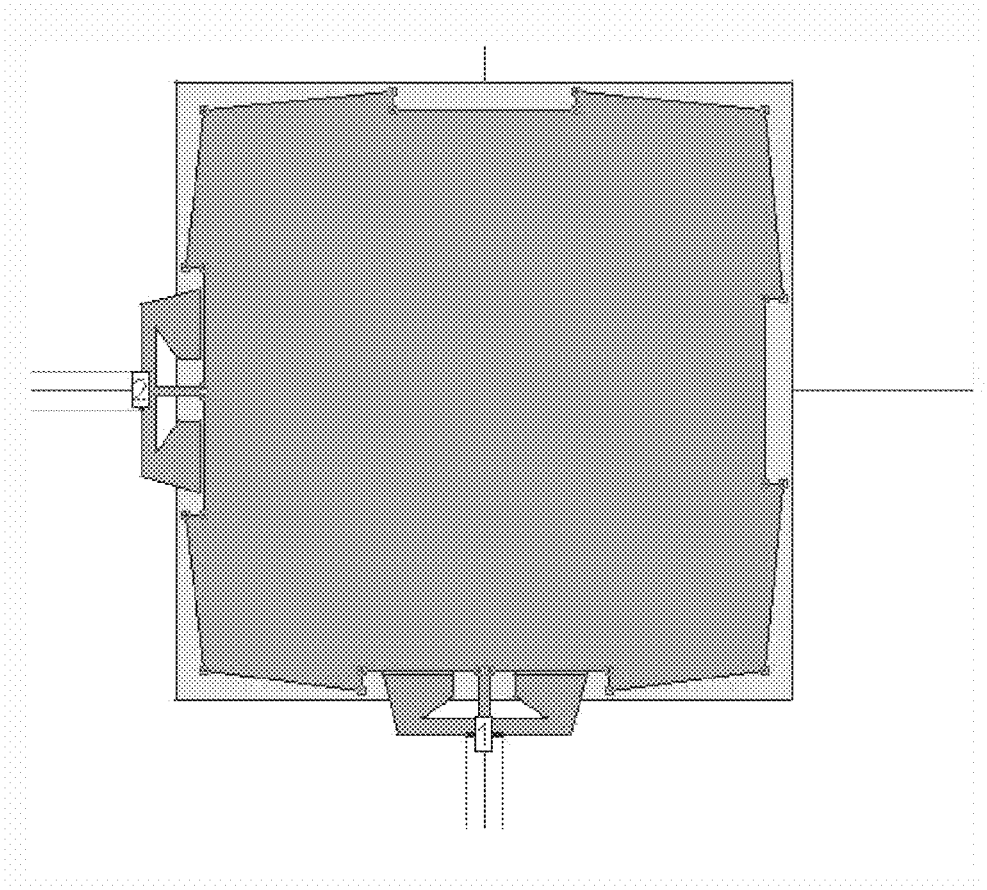
Figure 19F:
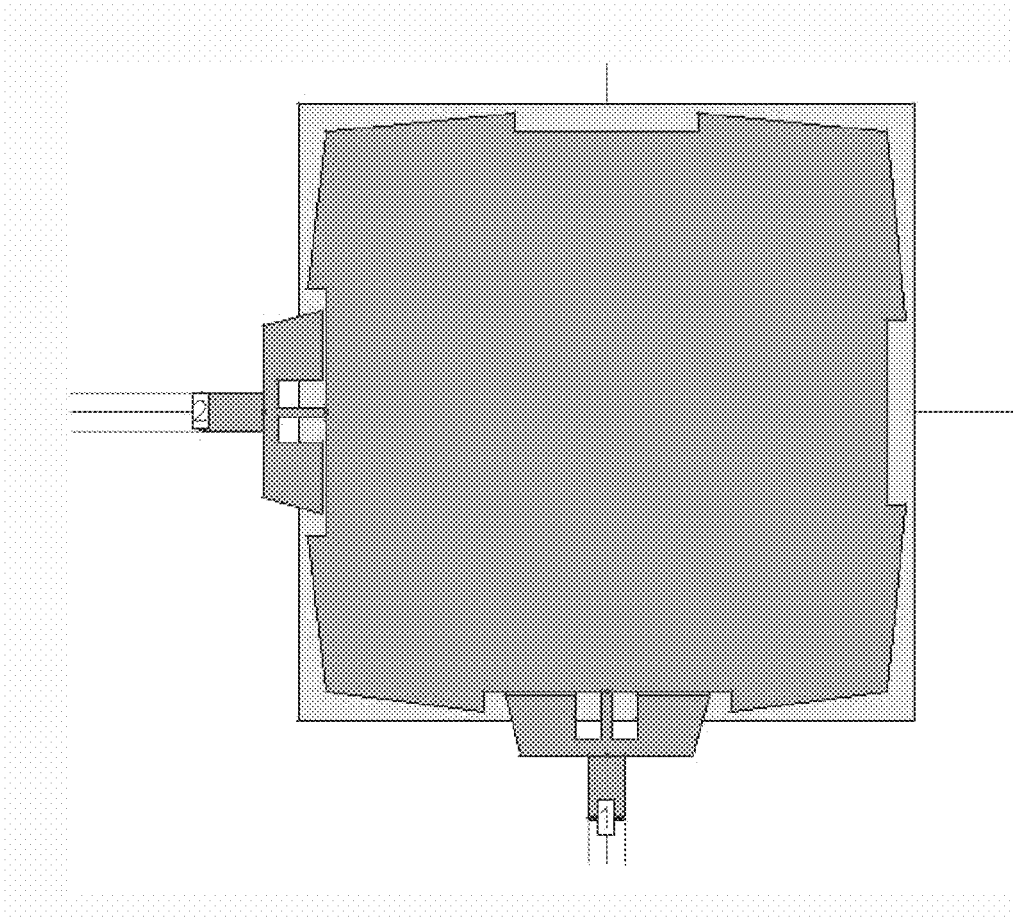
Figure 19G:
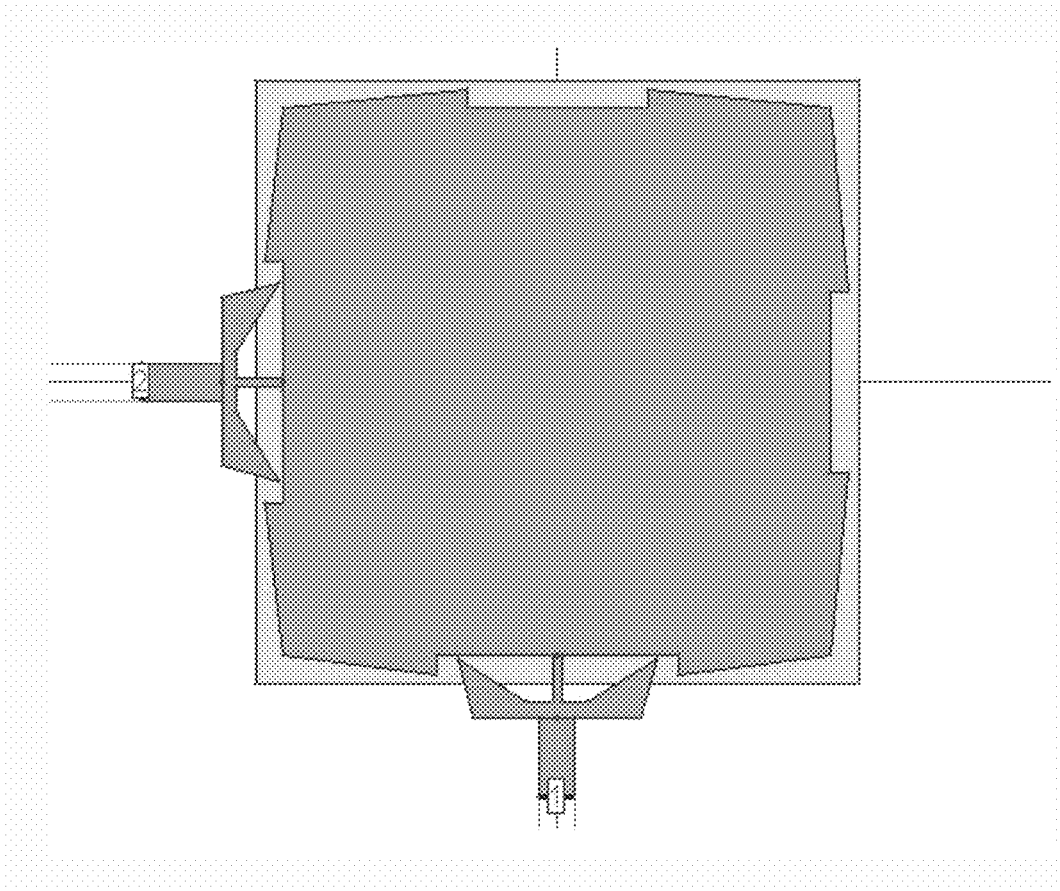
Figure 19H:
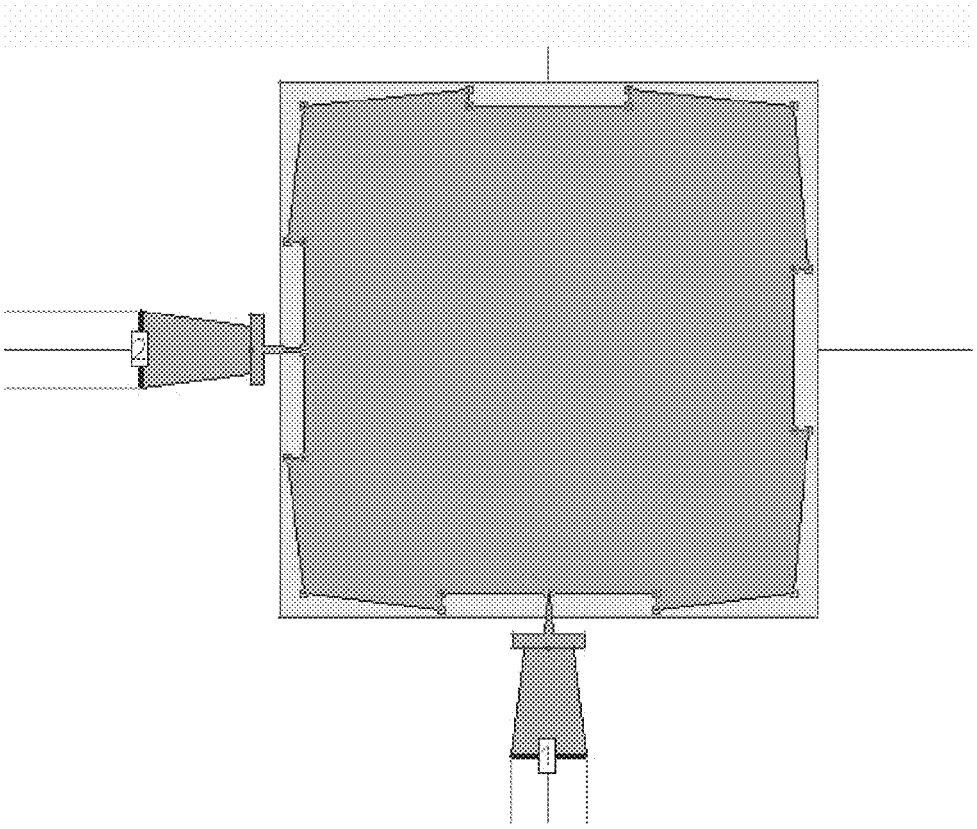
Figure 19I:
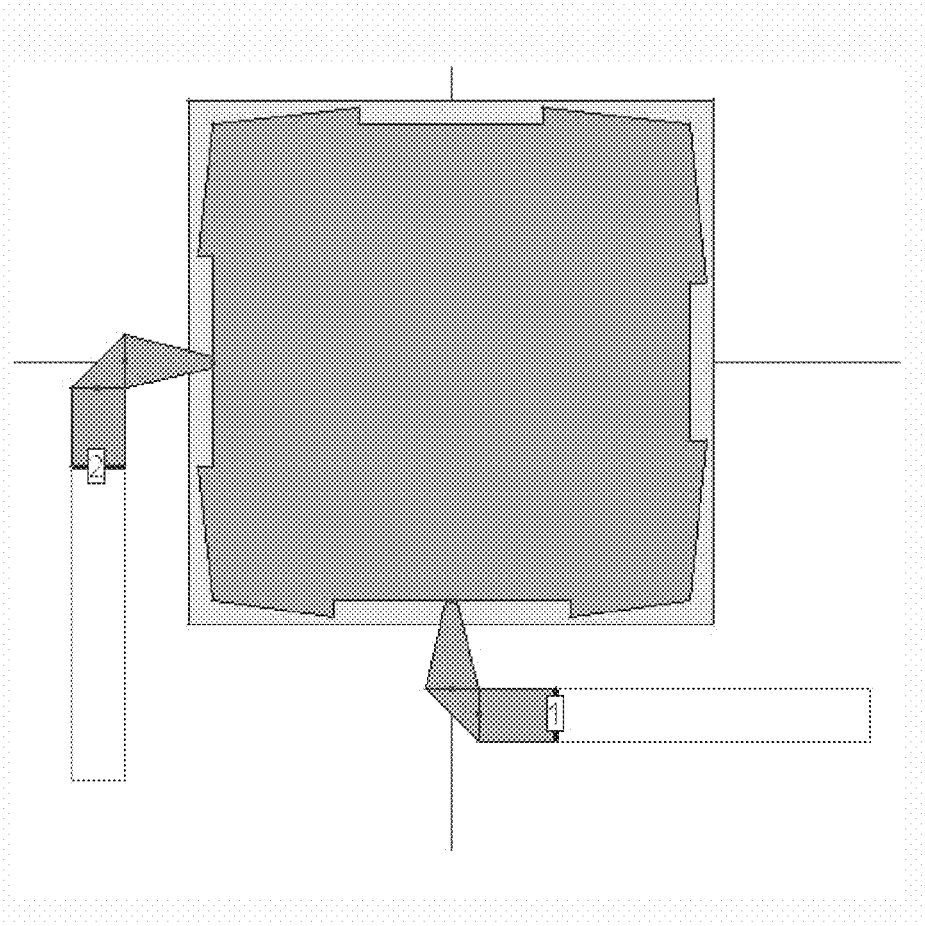

FIG. 9 shows details of the TSFR including an electrically connected central arm and capacitive side arms and is an enlarged and more detailed illustration of the patch and TSFR feed of FIGS. 1*a*-1*b* according to certain embodiments. It is appreciated that many variations are possible on the particular embodiment shown in FIG. 9 e.g. as shown in FIGS. 19*a*-19*j*, described below, of which FIGS. 19*g*, 19*h*, 19*i* show embodiments which are believed to lack certain of the advantages of FIGS. 9, 19*a*-19*f*, 19*j*. As shown, the connecting arm is typically but not necessarily (e.g. FIGS. 19*h*, 19*i*, 19*j*) augmented by a pair of capacitive arms.

The patch is shown non-square in that a pair of triangular portions at each vertex generate a bay or recess in the center of each of the patch's four sides. However, alternatively, these may be omitted and the patch may be square; the variations of FIG. 9 and of FIGS. 19*a*-19*i* at least were found to yield good results e.g. as evidenced by Smith charts.

Two ports are shown, e.g. for dual polarization, connected typically to the approximate midpoints of two of the patch's sides e.g. (by way of example) to the left (port 1 in FIG. 9; port 2 in FIGS. 19*a*-19*j*) and bottom (port 2, in FIG. 9; port 1 in FIGS. 19*a*-19*j*) sides of the patch. However, this is not intended to be limiting and a single port may be provided. For dual polarization, the arms provided at a first of the two ports may or may not be equal in number and configuration to the arms provided at the second of the two ports.

Figure 5:
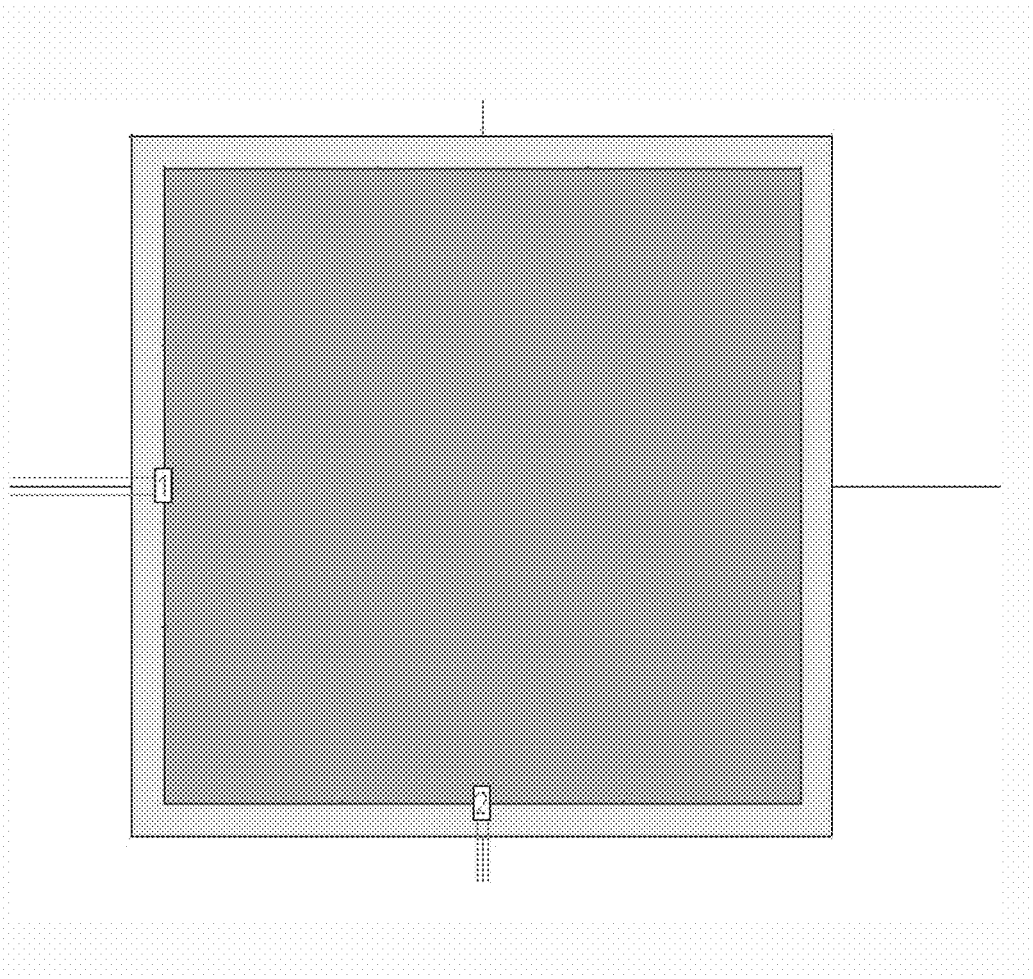
Fig 5 (PRIOR ART)
FIG. 5 is a diagram of a prior art Dual Polarized patch antenna with conventional feed.
Figure 6:
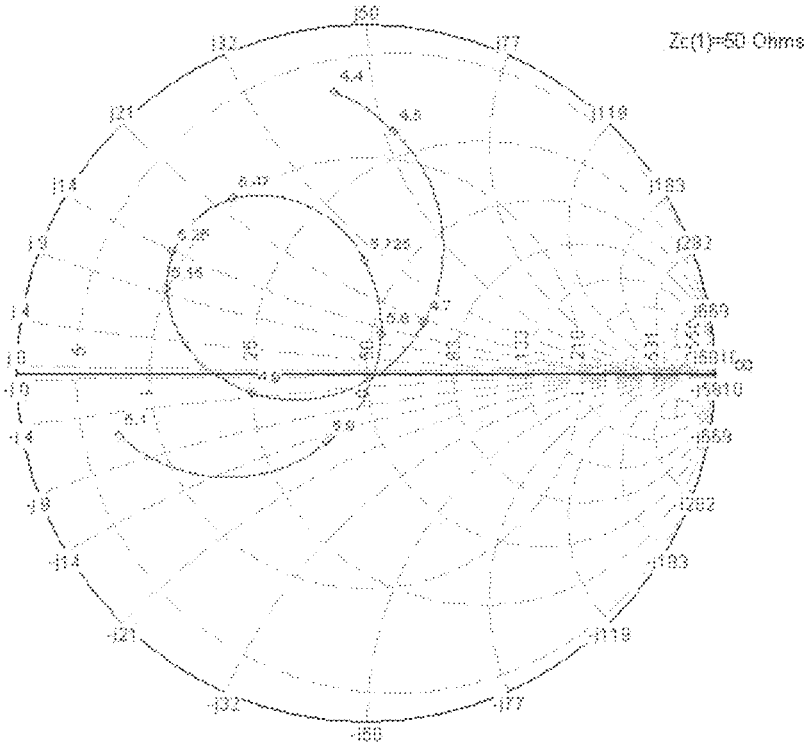
FIG. 6 (prior art) illustrates a Smith chart simulating impedance for a prior art Dual polarized Patch antenna with conventional feed e.g. the antenna of FIG. 5.
Figure 7:
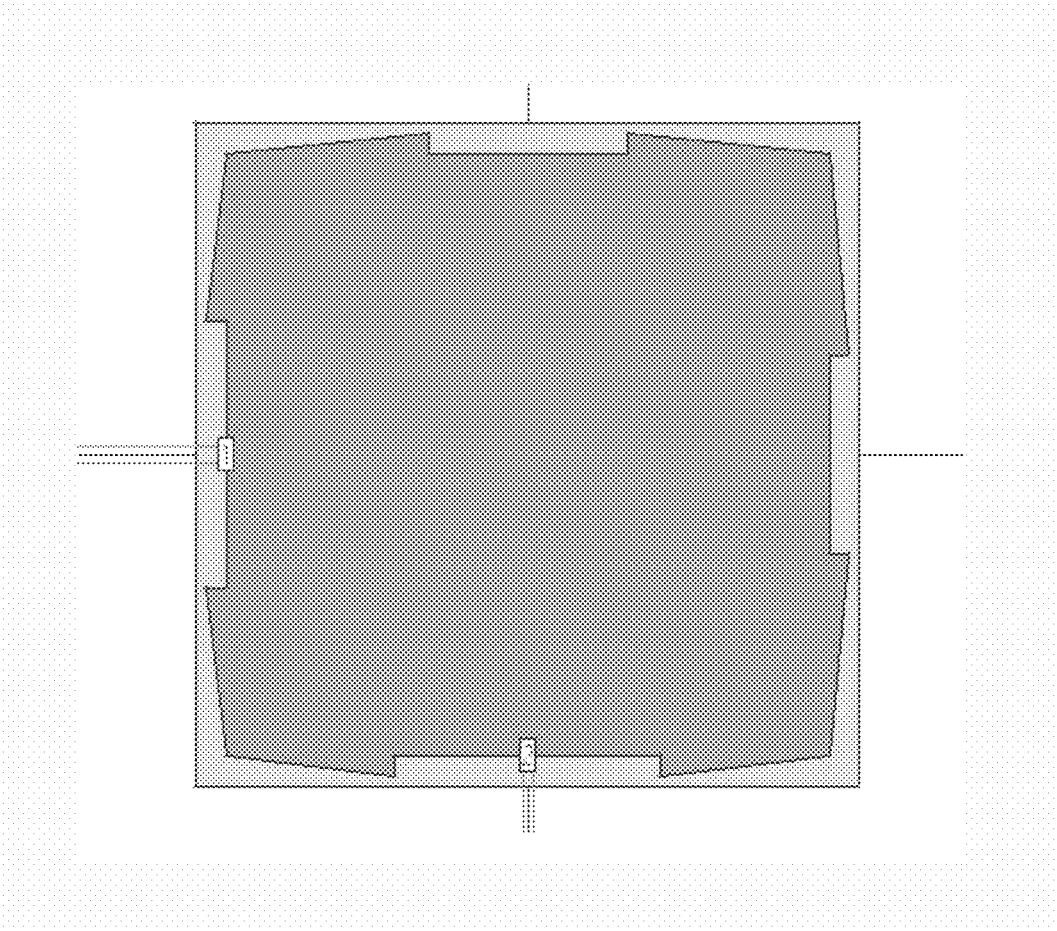
FIG. 7 is a diagram of a Shaped (rather than square) Patch Antenna according to an embodiment of the invention, having corners (vertices) defining angles in excess of 90 degrees.
Figure 8:
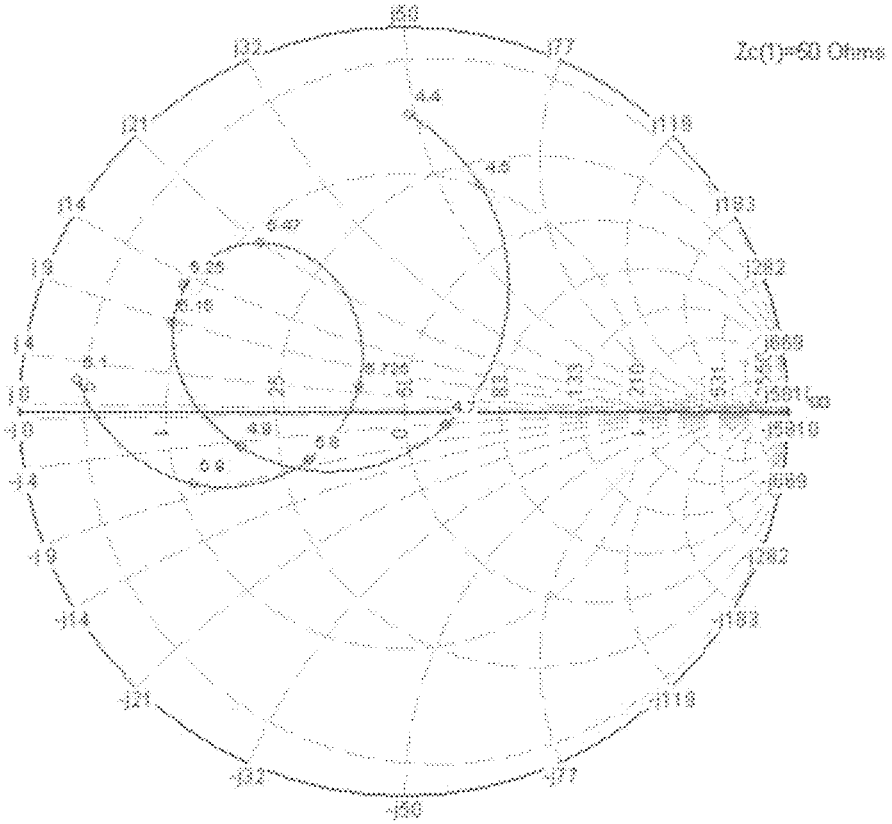
FIG. 8 illustrates a Smith Chart simulating impedance for a slotted patch antenna e.g. that shown in FIG. 7.
Figure 10:
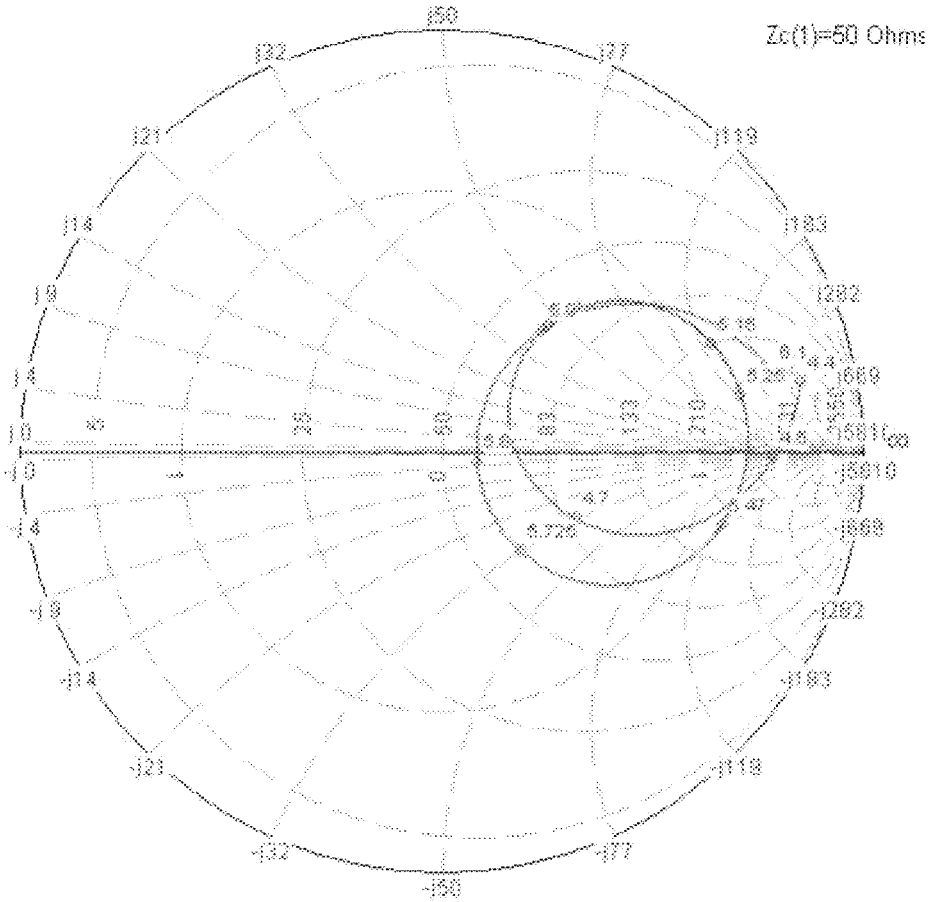
FIG. 10 illustrates a Smith chart simulating impedance for a patch antenna with TSFR Feed e.g. that shown in FIG. 9.

A method i for designing and manufacturing the dual polarised wideband patch of FIGS. 1*a*-1*b* may include some or all of the following operations, suitably ordered, e.g. as shown:

a) design a conventional patch e.g. as shown in prior art FIG. 5.

b) Simulate impedance over the bandwidth required for the application e.g. as shown in the Smith Chart of FIG. 6. As is evident from the Smith Chart, a patch in accordance with the present invention cannot be matched by a conventional patch of the same dimensions.

c) Increase the inductance of the patch of FIG. 5 at the high frequency end by changing the patch's shape (dovetailing the edges) e.g. as shown in FIG. 7.

d) Simulate impedance of the patch of FIG. 7 e.g. as shown in the Smith Chart of FIG. 8. It is appreciated that alternatively, a square patch may be employed.

e) Design TSFR feed, e.g. as shown in FIG. 9, for patch of FIG. 7 to optimize impedance bandwidth given the impedance data of FIG. 8.

f) Simulate impedance of the patch of FIG. 9 e.g. as shown in the Smith Chart of FIG. 10.

g) Optimize performance of the apparatus of FIG. 9, by suitable initial selection of height, thickness and material typically depending on frequency e.g. height may be around 0.01 wavelengths, and by providing a suitable radome whose material and height may be determined based on cost and availability.

A method ii for designing and manufacturing a dual polarized planar array of patches e.g. as shown in FIG. 2 may include some or all of the following operations, suitably ordered, e.g. as shown:

aa) Simulate an array of two antenna elements each using TSFR feed and each designed using method i above. An example array is shown in FIG. 11.

bb) Adjust matching lines (the microstrip lines connecting elements in array) for optimum impedance (See Smith Chart FIG. 12) using conventional methods. It is appreciated that once an individual element with the single element feed system as shown and described herein has been matched, conventional methods may be employed to match the whole array.

cc) Simulate an array of four antenna elements each using TSFR feed, the array including two arrays of two antenna elements each designed in accordance with steps aa, bb. An example 4-element array is shown in FIG. 13. A Smith chart for same is shown in FIG. 14.

dd) Assemble complete dual polarized planar antenna array shown in FIG. 2. Typically, the array is formed by interconnecting the 4-element arrays designed in step CC and adding single-polarization elements on left and right sides e.g. as shown in FIG. 3 to increase gain performance. It is appreciated that this configuration reduces the number of microstrip lines, and hence the overall size of the antenna.

A method iii for designing and manufacturing the antenna of FIG. 4, includes using the configuration of FIG. 3 multiple times to yield a full dual polarized planar array. Conventional methods may be employed to form a microstrip array from the individual elements.

Figure 12:
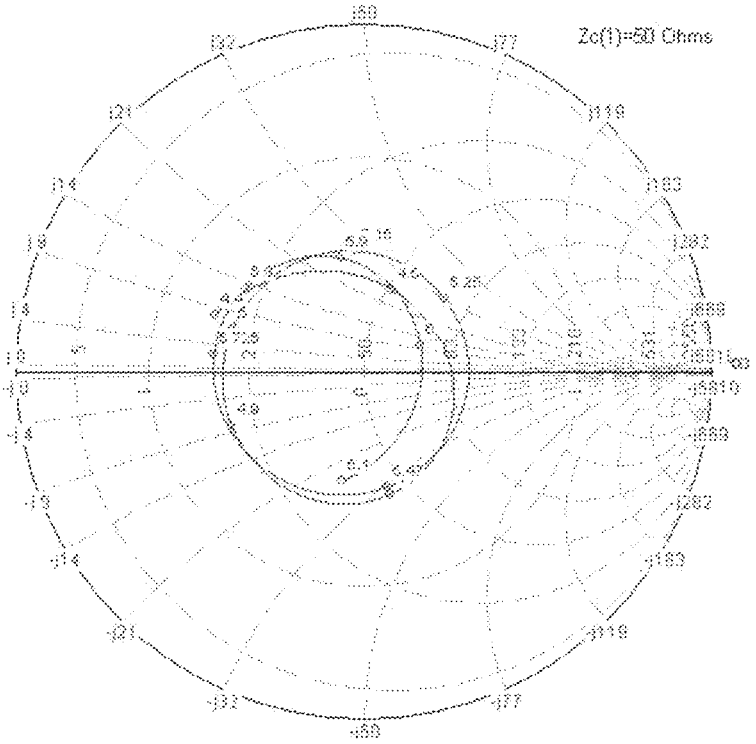
FIG. 12 illustrates a Smith chart simulating impedance for an array of two elements using TSFR feed e.g. that shown in FIG. 11.
Figure 14:
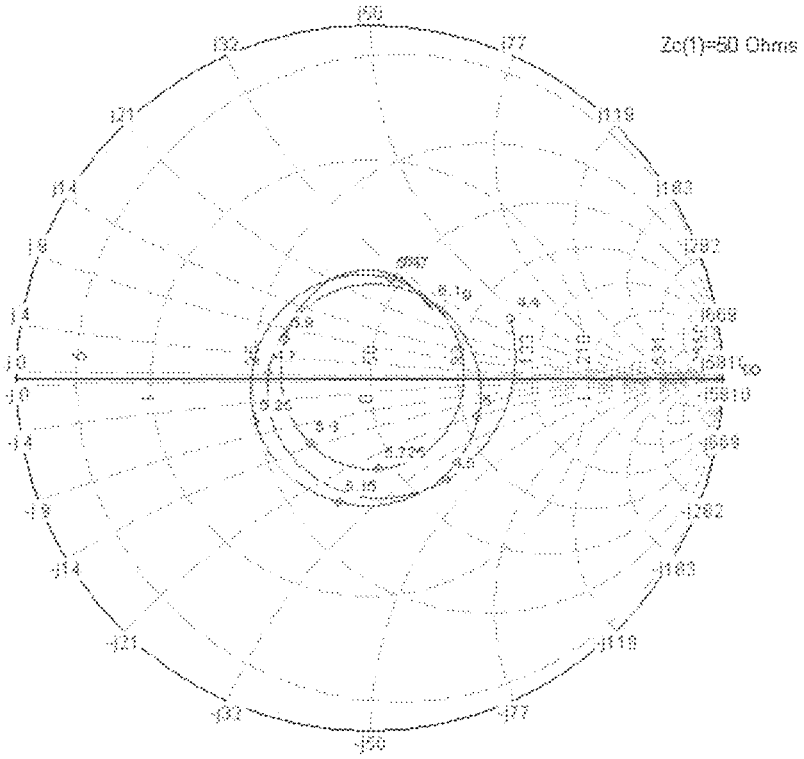
FIG. 14 illustrates a Smith Chart simulating impedance for a four element array using TSFR feed e.g. that shown in FIG. 13.

Referring now to FIGS. 11-14, FIG. 11 is a Dual Polarized Array of Two element antennae units, using TSFR Feed whereas FIG. 13 illustrates a Dual Polarized Array of four element antennae units. Thus, FIGS. 11 and 13 show arrays with two elements of the type shown e.g. in FIG. 9 and four 4 elements, respectively, connected by microstrip feed lines. Smith charts for these are shown in FIGS. 12 and 14 respectively.

Figure 15:
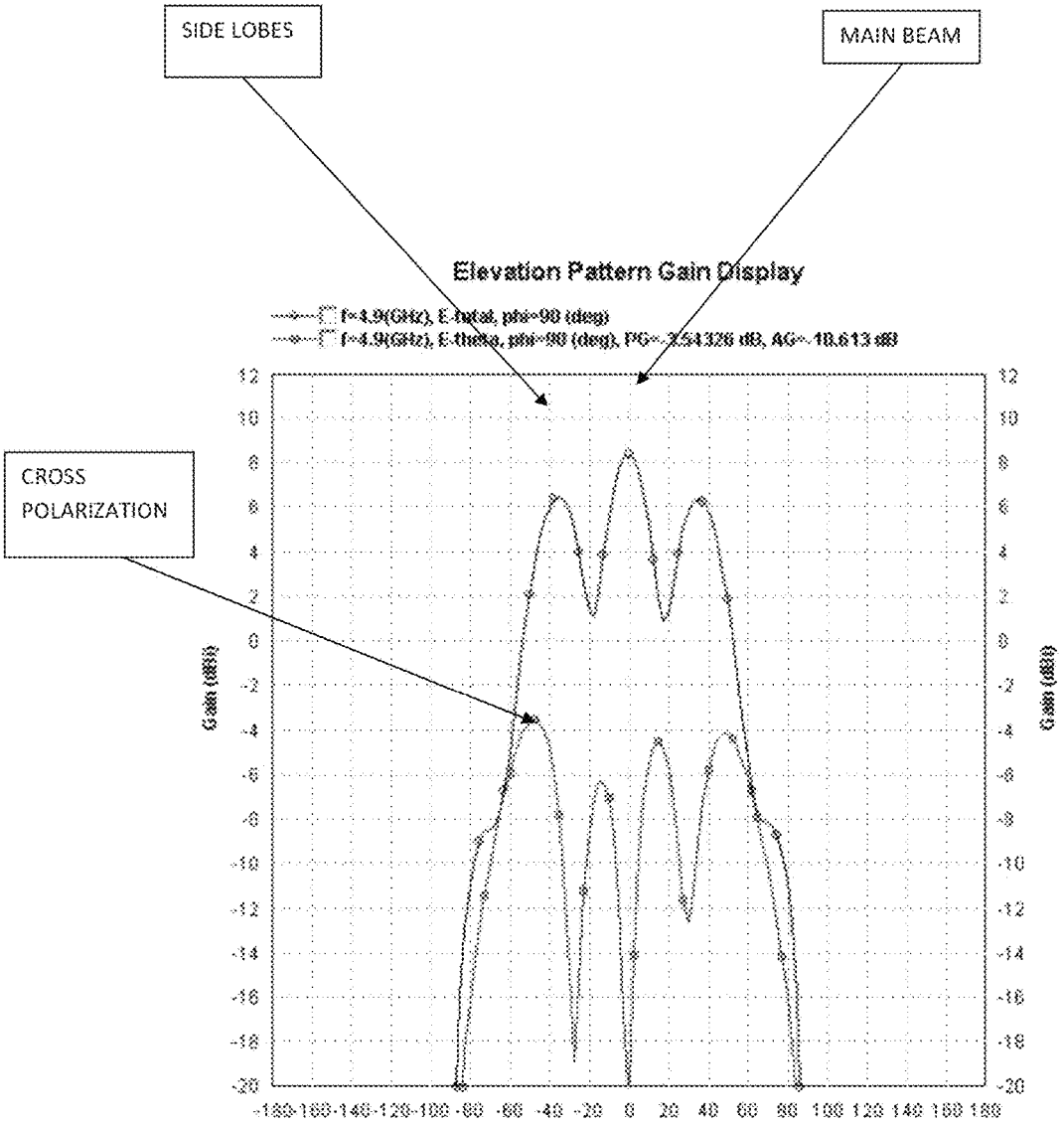
FIG. 15 is a graph of a Radiation Pattern at 4.9 Ghz, for a conventional antenna with regular feed as opposed to the TSFR feed apparatus shown and described herein.
Figure 16:
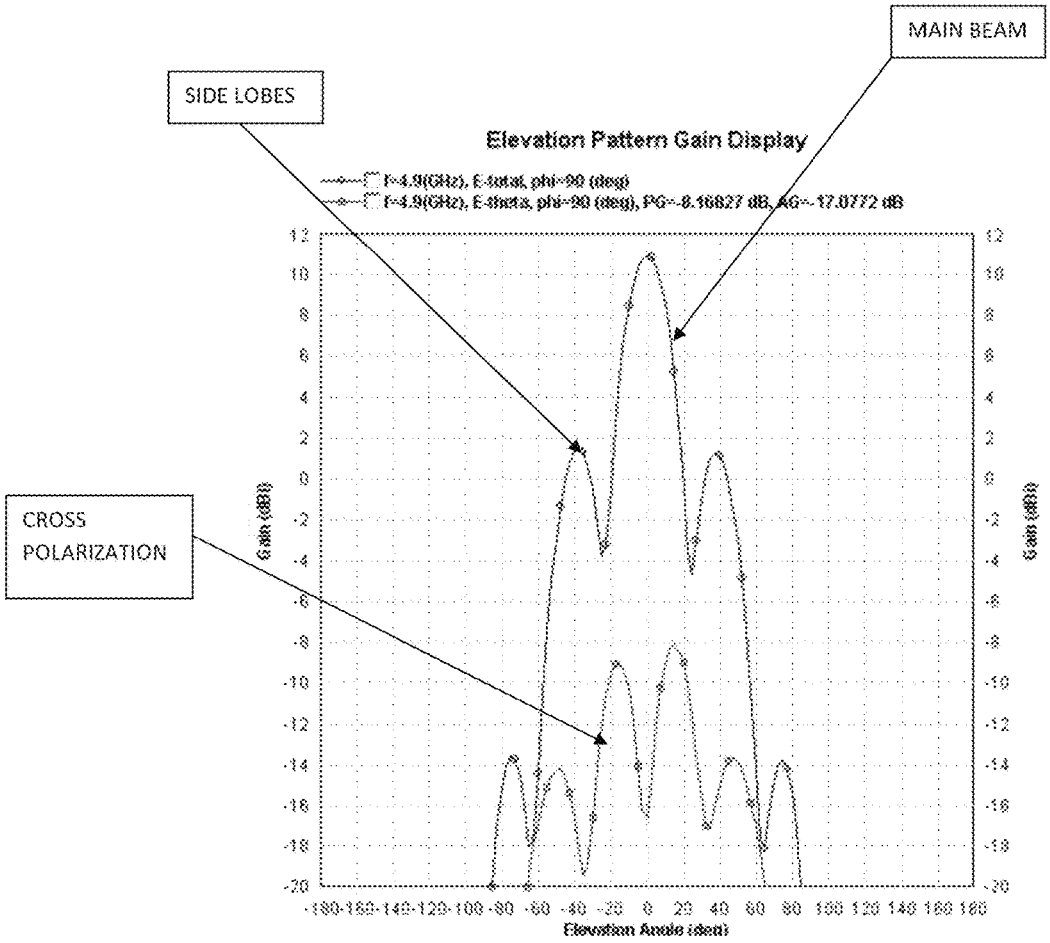
FIG. 16 is a graph of a Radiation Pattern at 4.9 Ghz for an antenna having TSFR feed apparatus as shown and described herein.
Figure 17:
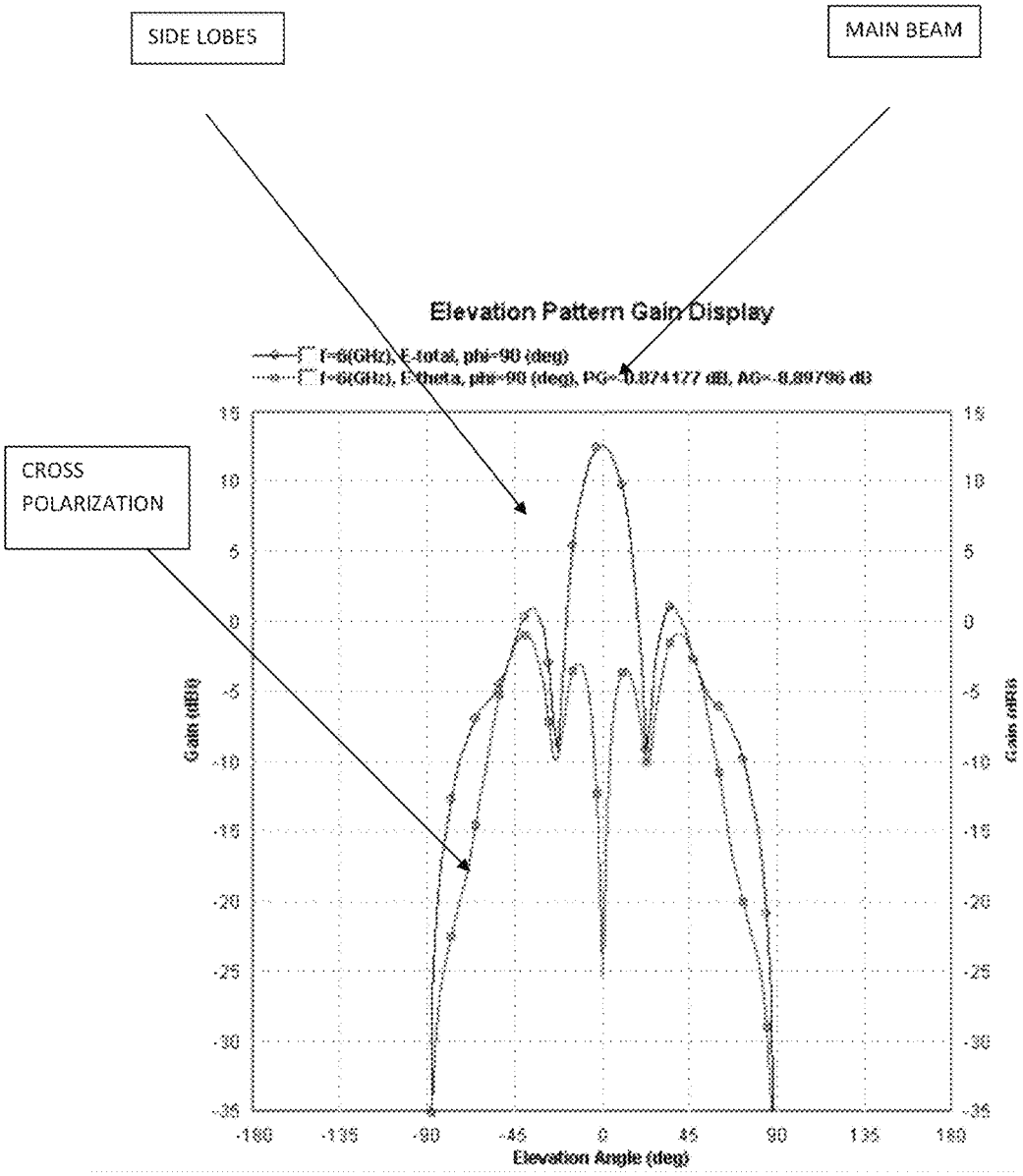
FIG. 17 is a graph of a Radiation Pattern at 6 Ghz for a conventional antenna with regular feed as opposed to the TSFR feed apparatus shown and described herein.
Figure 18:
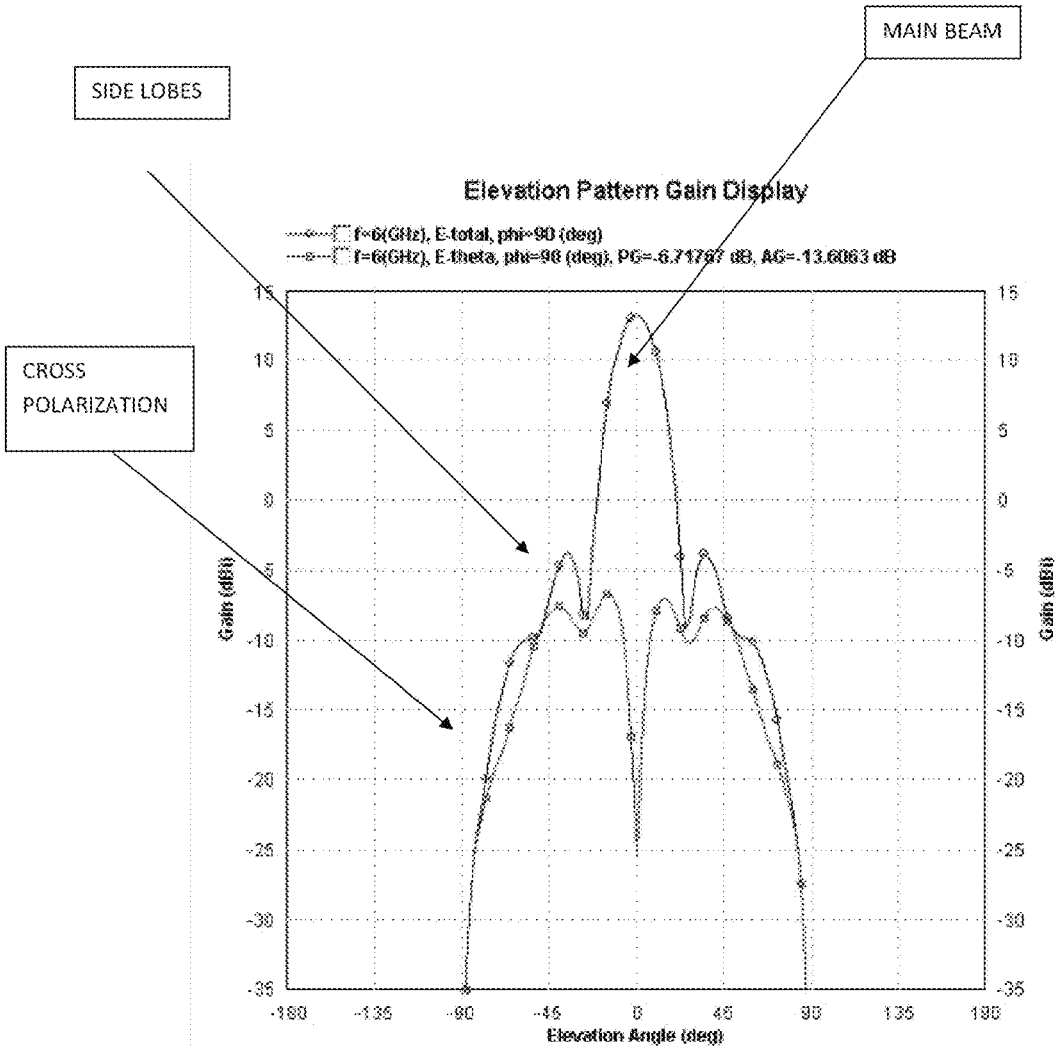
FIG. 18 is a graph of a Radiation Pattern at 6 GHz for an antenna having TSFR feed apparatus as shown and described herein e.g.

FIGS. 15, 16 show a radiation pattern of a four-element series feed array without the TSFR feed. The graphs are at the extremities of the frequency band. FIGS. 17, 18 show the radiation pattern using the TSFR feed. It can be observed that the cross polar and side lobe performance is reduced radically.

FIG. 15 is a graph of a Radiation Pattern at 4.9 Ghz, for a conventional antenna with regular feed as opposed to the TSFR feed apparatus shown and described herein.

FIG. 16 is a graph of a Radiation Pattern at 4.9 Ghz for an antenna having TSFR feed apparatus as shown and described herein.

FIG. 17 is a graph of a Radiation Pattern at 6 Ghz for a conventional antenna with regular feed as opposed to the TSFR feed apparatus shown and described herein.

FIG. 18 is a graph of a Radiation Pattern at 6 GHz for an antenna having TSFR feed apparatus as shown and described herein with reference to FIG. 3, with and without the TSFR feed on the elements at the extremities.

The apparatus shown and described herein provides at least one of the following advantages:

a. wide-band impedance transformation, e.g. similar to or even in excess of a dipole despite the narrow band-width of each patch which normally yields a frequency range of no more than 10% to 15%.

b. ability to provide a wide-band antenna including an entire (e.g. dual polarized) array of patch antennae thereby to provide a large flat antenna as opposed to other types of wideband elements which cannot be used in an array.

c. improved radiation pattern including enlarged main lobe and diminished side lobe/s, e.g. when series feed is employed.

For example, at least the apparatus of FIG. 9, and 3-arm variations thereupon may provide all of the above advantages.

The apparatus, as invented, includes but is not limited to, not only that shown in FIG. 9 by way of example, but also any apparatus which includes any subset of (any combination of) the following characteristics i-vii:

i. Patch is symmetric about one or both of its diagonals e.g. has identical recesses on all four sides, in contrast, say, to conventional E-patches and U-patches, thereby to allow arrays to be formed.

ii. Patch corners define angles which exceed 90 degrees.

iii. Patch has two or more sides, typically adjacent, which are electrically connected to one, two or more arms and/or one, two or more capacitively coupled arms.

iv. Capacitively coupled arms are "dovetailed" in that, as they come toward the patch, they flare outward such that the end of the arm which is adjacent to the patch, is wider than the end of the arm distant from the patch, thereby to yield wide-band inductance.

v. The patch and arms may be formed of any conductive material such as copper and may be integrally formed therewith e.g. etched on a single copper surface mounted on a suitable support such as a plastic base.

vi. The central arm is electrically connected to the patch.

vii. At least one patch side has recess/es to improve performance at the high-end of a frequency band. Recess depth is suitable to provide a desired impedance, given a particular frequency. For example, if the frequency is about 4.2 to 6.2 Ghz, the recesses may be 0.6 to 1.5 mm deep. Here and elsewhere, dimensions may be scaled for different frequencies according to the change in wavelength. A Recess may be electrically connected to one, two or more connected arms and/or one, two or more capacitively coupled arms.

Figure 19J:
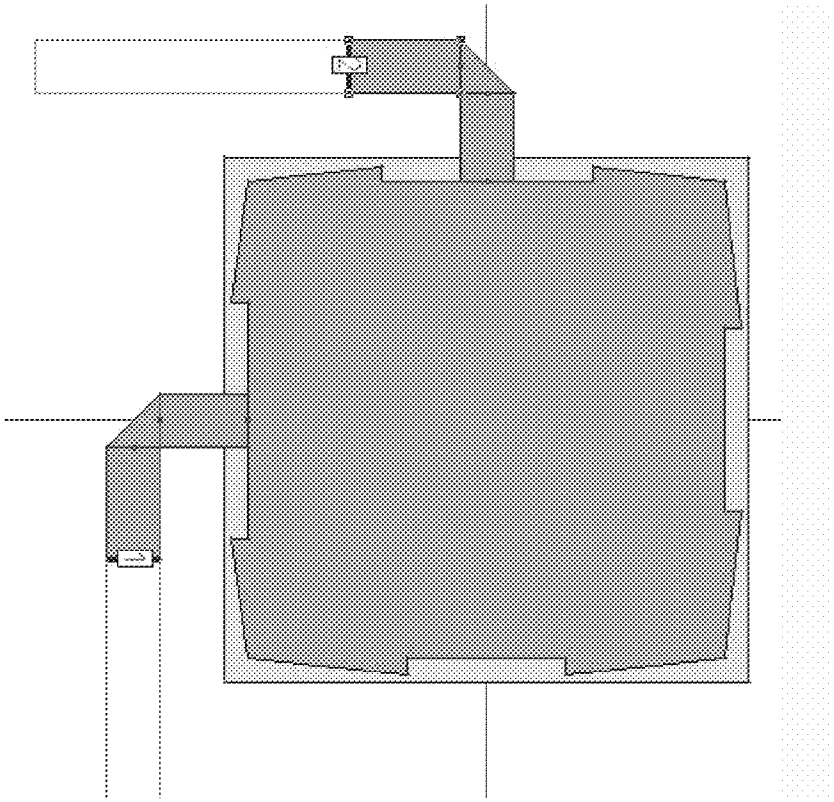

It is appreciated that the characteristics illustrated in FIG. 9 by way of example may be extensively varied. For example, some or all of the following need not be as illustrated:

1. Depth of some or all of the 4 arm-receiving recesses in the 4 sides of the patch respectively 2. Length of some or all of the 4 arm-receiving recesses in the 4 sides of the patch respectively—in absolute terms or proportional to length of patch-side
3. Angles shown, e.g. between recess walls and floor
4. Angles of, and identicality (yes/no) of "triangles" formed by secondary arms as shown. Configuration of these triangles (equilateral, isosceles, other) formed (or not) by halves which are symmetric about a perpendicular extending toward the patch
5. Size of capacitive gap between capacitive arms and patch
6. Shape or size of central arm: dimensions and/or angles, and/or relationships between any of the above
7. Angle of patch "corners"
8. Shape or size of connecting bar which connects the 3 arms
9. Geometrical features of the various elements shown in FIG. 9 may, some or all, be curved rather than straight
10. Ratios between any 2 characteristics on the above list For example, FIGS. 19*a*-19*j* are examples of possible variations on the shape of the connecting and capacitive arms, shown in conjunction with their associated patch and optional parasite; all of these variations as well as combinations thereof, are included within the scope of the present invention. As shown, some or all of the capacitive arms may flare outward non-uniformly e.g. only in part or e.g. only on the side of the arm facing the central arm; the side of the capacitive arm facing outward i.e. away from the central arm, may, say, be perpendicular to the patch edge rather than flaring out, e.g. as shown in FIG. 19*a*. The arms need not flare outward evenly e.g. as shown in FIG. 19*b*, arms may begin with a portion of uniform width and may widen, suddenly or gradually, only as they approach the patch, e.g. as shown in FIG. 19*b* (as compared e.g. to FIG. 19*a*), or as shown in FIG. 19*c* (as compared e.g. to FIG. 9). Portions of the cross-section of the capacitive arms may, as mentioned above, be perpendicular to the patch e.g. as shown in FIG. 19*b* and FIG. 19*d*. Conversely, arms may begin with a flaring-out portion and, as they approach the patch, may flare out less as shown (one side of the cross-section is perpendicular to the patch e.g.) or even not at all (both sides of the cross-section may be perpendicular to the patch, e.g. at the portion where the arm contacts the patch). So, flaring out of, say, a capacitive arm, may be large or (as shown in FIG. 19*f* for example) small, may be step-wise or continuous, may be partial (on one side only), or any other variation. The arms may not flare out at all, e.g. as shown in FIG. 19*g* in which the capacitive arms "flare in" i.e. are initially wide and then narrow to a point at the location where the arm is closest to the patch edge. The width of the arms may be changed as suitable, for example, the connecting arm is narrower in FIGS. 19*a*, 19*f* and 19*g*. The two capacitive arms may or may not be enantiomers and may even be omitted entirely e.g. as shown in FIGS. 19*h*-19*j*. Any suitable dimensions and angles may be employed; for example the drawings may be used to-scale.

Certain embodiments seek to increase the size of the parasitic element e.g. by almost 50% with consequent increase in gain and directionality, without affecting the resonance frequency, by splitting the parasitic elements into a plurality of disjoint or almost disjoint elements or portions. ("disjoint" refers to elements which have no connecting portion hence are completely separate; as opposed to elements which are almost disjoint which might be spaced from one another other than a connecting portion therebetween.

According to certain embodiments, an antenna, e.g. a printed patch antenna, is provided which includes a plurality of parasitic elements above at least one active element.

A particular advantage is that the size of the parasitic elements may be selected to be sufficiently large as to ensure a given level of gain (and directionality)—without changing the resonance frequency.

Example: Given is a 4-layer antenna including a first layer (e.g. formed of Teflon CLP with a dielectric constant of 2.45 on a Ground Plate, a second air level between the first and third levels, a 3 level formed of fr-4 having a dielectric constant of 4.7 at a height of 3.6 mm over the Ground plate) and a fourth level comprising a Radome at a 32 mm height relative to the Ground Plate and having a dielectric constant of 2.96). Rather than providing a 19.7 mm parasitic element designed to yield a resonance frequency of 5.5 GHz, a 2×2 array of quadrilateral parasitic elements whose total size is, say, 8 mm larger (27.6 mm) may be provided without undesirably altering the resonance frequency, thereby substantially increasing the antenna's gain, e.g. at the ends of the frequency range, and directionality.

In contrast, in conventional antennae in which a single parasitic element is provided, it is typically the case that increasing the parasitic element's size (to increase the gain), even by a single millimeter, will simultaneously cause an undesirable increase in the resonance frequency.

The size of each of the parasitic elements may be determined depending inter alia on the size and height of the radome and the material from which the active element is formed.

The spacing between adjacent parasitic elements may (e.g. for the above example) be approximately 0.2 mm plus-minus a few tenths of a millimeter. The spacing between the adjacent parasitic elements may depend on the antenna's structure (e.g. one or ore of: layers including dielectric constants thereof, dimensions e.g. separation between layers) and may be determined empirically to ensure that the enlarged "total" parasitic element increases the gain without affecting the desired resonance frequency. For example, separations such as 0.1 mm, 0.15 mm, 0.22 mm, 0.25 mm, 0.3 mm or other values between, say, 0.05 mm and 0.5 mm or even more, may be employed.

Figure 20:
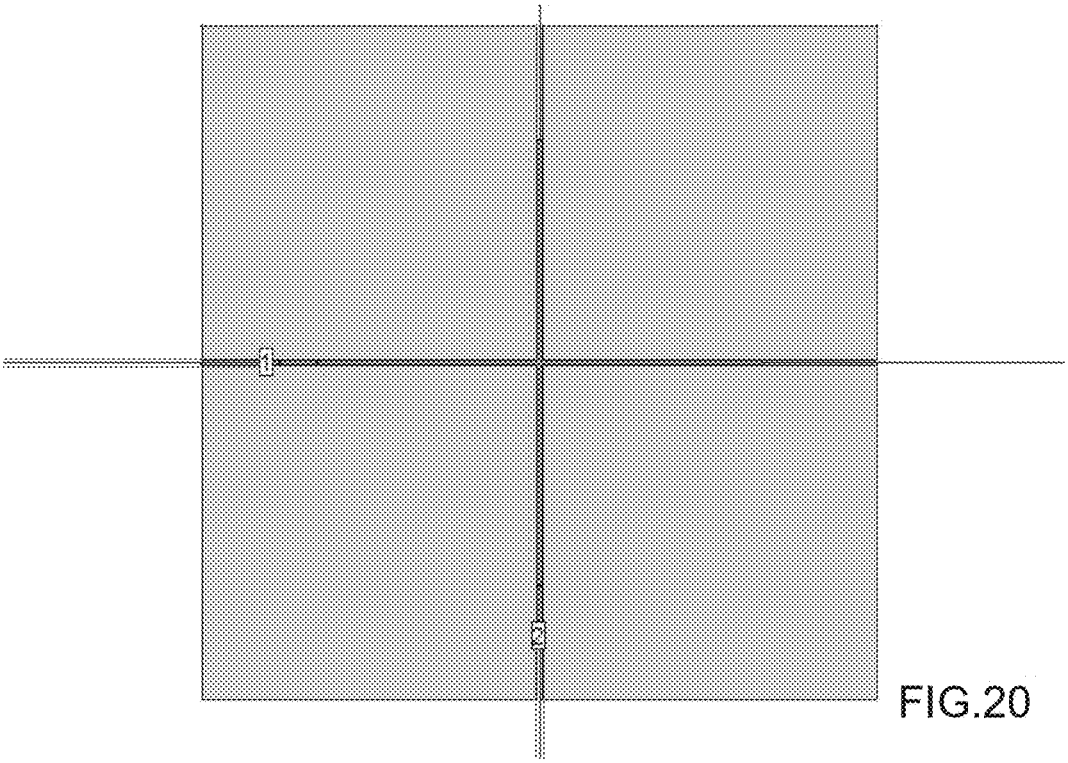
FIG. 20 is a bottom view of a parasitic patch above an antenna's active element, the parasitic patch including a plurality of parasitic elements or "tiles".

In the illustrated embodiment, the plurality of parasitic elements are completely disjoint i.e. are completely separate. For example:

FIG. 20 is a bottom view of a parasitic patch above an antenna's active element, the parasitic patch including a plurality of parasitic elements or "tiles".

Figure 21:
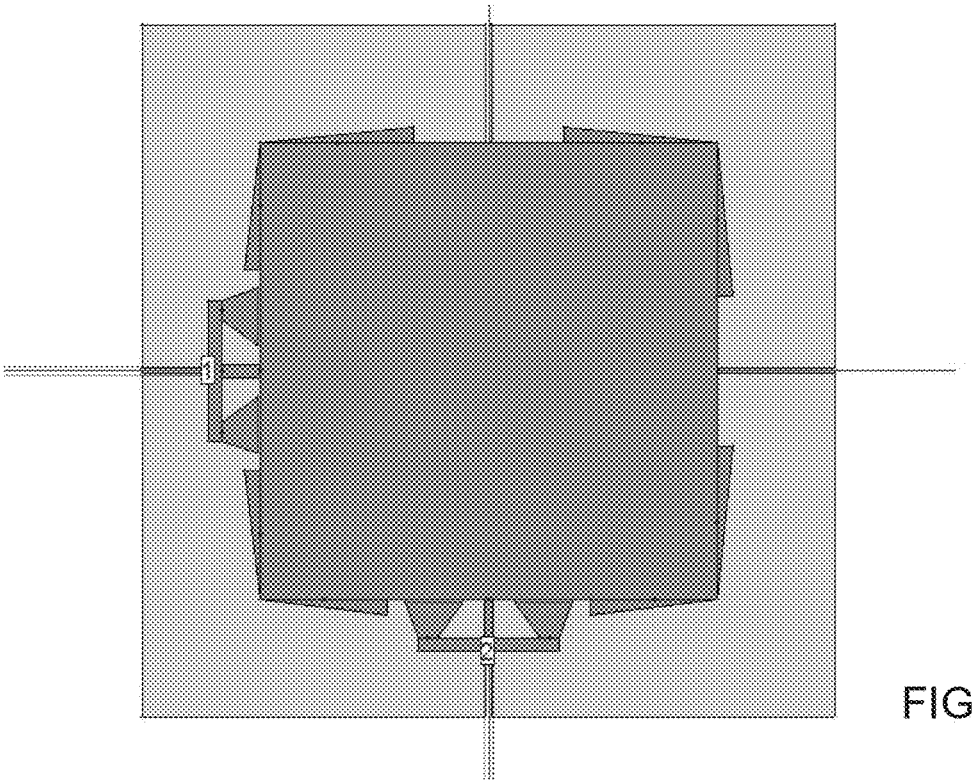
FIG. 21 is a top view of a parasitic patch above an antenna's active element, the parasitic patch including a plurality of parasitic elements or "tiles".

FIG. 21 is a top view of a parasitic patch above an antenna's active element, the parasitic patch including a plurality of parasitic elements or "tiles".

However, it is believed that alternatively, the plurality of parasitic elements may be only partially disjoint i.e. may not be completely separate. For example, a single parasitic page may be employed, which includes orthogonal slits extending respectively along most but not all of the two bisecting axes of the page. These slits partition the page into (say) a 2×2 array of square parasitic portions which are almost but not completely disjoint. The widths of the slits may for example be approximately 0.2 mm plus-minus a few tenths of a millimeter.

In the illustrated embodiment, each of the plurality of parasitic elements are squares; however it is believed that alternatively, each of the plurality of parasitic elements may have any suitable shape such as rectangular, triangular, hexagonal or octagonal shapes.

In the illustrated embodiment, the total shape formed by all of the plurality of parasitic elements, is a square (formed in the illustrated embodiment by a 2×2 array of smaller squares). However, it is believed that alternatively, the total shape formed by all of the plurality of parasitic elements may have any other suitable shape such as a circle, equilateral and/or equiangular hexagon or octagon, equilateral (e.g.) triangle or any polygon such as a equilateral and equiangular (regular) polygon.

According to certain embodiments, e.g. for a dual-pole antenna, the plurality of parasitic elements is arranged e.g. symmetrically about a point (typically directly above the center-point of the active element).

In the illustrated embodiment, 4 parasitic elements are employed; however this is not intended to be limiting.

According to certain embodiments, given a particular antenna and a desired resonance frequency, the size of the "total" parasite element (comprising a single parasite element in conventional antennae) is determined conventionally. For example, the dimension of the page (of the single element) may be half the wavelength in air, adjusted conventionally to take into account the effective dielectric constant given the materials used for the antenna—e.g. by dividing by the square of the di-electric constant. Then, a larger "total" parasite element, comprising a plurality of parasite elements, disjoint or almost or partially disjoint, is provided, whose size is larger than that determined conventionally. For example, a pattern of parasitic elements (such as 2×2 squares or other patterns described herein) may be selected. Next, a spacing, such as 0.2 mm, may be selected and an increased-size pattern (such as 2×2 squares (say) whose total size is 20% larger than the total size conventionally determined above) may be tested or simulated to confirm that the resonance frequency has not increased. If the resonance frequency has undesirably changed given 0.2 mm spacing, testing should be carried out for a spacing 1 or a few tenths of a millimeter larger or smaller until a spacing has been found which does not change the desired resonance frequency. Then, the size of the "total" parasite element, comprising a plurality of parasite elements, may be further increased and tested or simulated, until a size which desirably or maximally increases gain and directionality, without unacceptably affecting the resonance frequency, is achieved. Conventional simulation software which may be used for this purpose is for example the HyperLynx 3D EM Design System.

It is appreciated that the apparatus shown and described herein have a wide variety of applications e.g. in antennas for radio broadcasting, broadcast television, two-way radio, communication receivers, radar, cell phones, satellite communications, Bluetooth enabled devices, wireless computer networks, including in devices such as but not limited to garage door openers, wireless microphones, baby monitors, and RFID tags.

It is appreciated that terminology such as "mandatory", "required", "need" and "must" refer to implementation choices made within the context of a particular implementation or application described herewithin for clarity and are not intended to be limiting since in an alternative implementation, the same elements might be defined as not mandatory and not required or might even be eliminated altogether.

The scope of the present invention is not limited to structures and functions specifically described herein and is also intended to include devices which have the capacity to yield a structure, or perform a function, described herein, such that even though users of the device may not use the capacity, they are, if they so desire, able to modify the device to obtain the structure or function.

Features of the present invention which are described in the context of separate embodiments may also be provided in combination in a single embodiment.

Conversely, features of the invention, including method steps, which are described for brevity in the context of a single embodiment or in a certain order may be provided separately or in any suitable subcombination or in a different order. "e.g." is used herein in the sense of a specific example which is not intended to be limiting. It is appreciated that in the description and drawings shown and described herein, functionalities described or illustrated as systems and sub-units thereof can also be provided as methods and steps therewithin, and functionalities described or illustrated as methods and steps therewithin can also be provided as systems and sub-units thereof. The scale used to illustrate various elements in the drawings is merely exemplary and/or appropriate for clarity of presentation and is not intended to be limiting.

The invention claimed is:

1. A flat antenna element including:

at least one first radiating patch, and at least one first multi-arm impedance transformer, wherein the first multi-arm impedance transformer is configured to perform an impedance transformation between an individual feed line and said first radiating patch and includes:

an arm having one side connected to said individual feed line, a central arm extending towards said first radiating patch, said central arm having a first end connected to another side of said arm, a second end connected to said first radiating patch through a direct physical and electrical connection, at least one additional lateral arm extending towards said first radiating patch, said additional lateral arm having a first end connected to said other side of said arm, and a second end connected to said first radiating patch through a capacitive electrical connection, and at least two distinct parasitic elements both located directly above the same first radiating patch, wherein said two parasitic elements are located substantially in the same plane, wherein said two parasitic elements are located totally or at least partially above said same first radiating patch.

2. The antenna element according to claim 1, wherein said at least one additional lateral arm comprises a pair of arms capacitively coupled to said first radiating patch and disposed on either side of the central arm.

3. A multi-element wideband planar antenna array including an array of inter-connected antenna elements according to claim 1 thereby to increase antenna gain.

4. The antenna element according to claim 1, further comprising a parasite patch above said at least one first radiating patch operative to modify the radiation pattern of radio waves emitted by said at least one first radiating patch.

5. The antenna element according to claim 4, wherein said at least one first parasite patch is slotted to increase inductance of the patch at a high frequency end.

6. The antenna element according to claim 1, wherein first and second inputs are provided for respective first and second polarizations such that a single element may be used for both of the polarizations.

7. The antenna element according to claim 1, wherein two multi-arm impedance transformers are employed to feed a single radiating patch, thereby to yield a dual-polarized antenna element.

8. A multi-element wideband dual polarized planar antenna array comprising at least a pair of antenna elements according to claim 1, which are connected by micro-strip feed lines.

9. A method for production of a flat antenna element, the method comprising:

providing at least one first radiating patch; and at least one first multi-arm impedance transformer comprising an arm having one side connected to an individual feed line, a central arm having a first end connected to an other side of said arm, and at least one additional lateral arm having a first end connected to said other side of said arm connecting a second end of the central arm to said first radiating patch through a direct electrical connection, and connecting a second end of said additional lateral arm to said first radiating patch through a capacitive electrical connection, wherein at least two distinct parasitic elements are both located directly above the same first radiating patch, wherein said two parasitic elements are located substantially in the same plane, wherein said two parasitic elements are located totally or a least partially above said same first radiating patch.

10. The antenna element according to claim 1, wherein the central arm is electrically connected to said at least one first radiating patch at an approximate midpoint of a side of the radiating patch.

11. An antenna element comprising at least:

two antenna elements with parallel feeds, and two other antenna elements according to claim 1 on a wideband array, wherein the two antenna elements are connected to the said two antenna elements by series feed lines, thereby changing the current distribution to result in a radiation pattern with reduced side lobes.

12. The antenna element according to claim 1, wherein the at least one first multi-arm impedance transformer comprises two multi-arm impedance transformers such that said antenna is dual-polarized.

13. The antenna element of claim 1, wherein said second end of said central arm electrically connected to said first radiating patch has a width to yield a level of impedance, at said arm connected to said feed line, which is more than the level of impedance of said first radiating patch.

* * * * *